US006381831B1

(12) United States Patent
Suzuki

(10) Patent No.: US 6,381,831 B1
(45) Date of Patent: May 7, 2002

(54) TERMINAL MOUNTING MACHINE

(75) Inventor: Toshiaki Suzuki, Nagoya (JP)

(73) Assignees: Autonetworks Technologies, Ltd., Nagoya; Sumitomo Wiring Systems, Ltd., Mie; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/520,717

(22) Filed: Mar. 8, 2000

(30) Foreign Application Priority Data

May 27, 1999 (JP) ..... 11-148694

(51) Int. Cl.[7] ..... H01R 43/00

(52) U.S. Cl. ..... 29/564.6; 29/33 M; 29/564.8; 29/747; 227/96

(58) Field of Search ..... 29/564.4, 564.6, 29/564.8, 33 M, 564.1, 566.2, 749, 747, 751, 759, 884, 881, 753; 227/96

(56) References Cited

U.S. PATENT DOCUMENTS

| | | | | |
|---|---|---|---|---|
| 3,641,646 A | * | 2/1972 | Folk | 29/33 M |
| 4,271,581 A | * | 6/1981 | Eitzinger | 29/564.6 |
| 4,531,280 A | * | 7/1985 | Bakersman | 29/564.6 |

FOREIGN PATENT DOCUMENTS

| | | | | |
|---|---|---|---|---|
| CH | 68 6807 | * | 6/1996 | 29/33 M |
| EP | 413157 | * | 8/1991 | 29/33 M |
| JP | A-9-145328 | | 6/1997 | |
| JP | A-10-106374 | | 4/1998 | |
| JP | A-10-154423 | | 6/1998 | |
| JP | A-10-212068 | | 8/1998 | |
| JP | A-10-241473 | | 9/1998 | |

* cited by examiner

*Primary Examiner*—William Briggs
(74) *Attorney, Agent, or Firm*—Oliff & Berridge, PLC

(57) ABSTRACT

A feeding pin 146 is downwards inserted into an insertion hole h formed in a direction in which the hoop T is fed so that the feeding pin 146 is moved in the feeding direction. The feeding pin 146 is completely caught by the hoop T to restrain the hoop T in the feeding direction. Thus, overrunning of the hoop T can completely be prevented. Thus, the hoop T can be stopped at a predetermined position. Moreover, cutting of the hoop T and separation of the terminal by cutting can accurately be performed. A hoop holding pin 151 is downwards inserted into the insertion hole h formed at a position different from a position at which the feeding pin 146 is inserted prior to insertion and removal of the feeding pin 146. Thus, further accurate feeding of the hoop T can be performed and, therefore, accurate cutting of the hoop T and separation of the terminal by cutting can be performed.

9 Claims, 35 Drawing Sheets

TERMINAL MOUNTING MACHINE

BACKGROUND OF THE INVENTION

The present invention relates to an apparatus for mounting a terminal on a connector housing of a wire harness for use in an automobile or the like and an apparatus for manufacturing a wire harness incorporating the mounting apparatus.

A connector C for a wire harness structured, for example, as shown in FIG. 35 is known. A terminal is mounted on a lower connector housing C12 of a connector C1 consisting of an upper connector housing C11 and a lower connector housing C12. Then, an electric wire a is connected to the terminal, and then the two housings C11 and C12 are engaged to each other. Thus, a wire harness W structured as shown in FIG. 36 is obtained. The terminal t has a slot wall u and a barrel portion b. As shown in FIG. 35A, a predetermined number of independent terminals t separated from a terminal hoop T formed by connecting a multiplicity of the terminals t are inserted into a cavity s of the housing C from a horizontal direction. The upper cover of the upper connector housing C11 is rotated inversely as indicated by an arrow shown in FIG. 35B after the connection n has been cut so as to be engaged to the body as shown in FIG. 35C (as for details, refer to the Japanese Patent Application No. Hei 9-145328).

When the terminal t is mounted on the connector C as described above, the mounting operation is usually automated as follows: The terminal hoop T formed by connecting the terminals t at predetermined pitches is moved to a predetermined cutting position by a feeding mechanism. The hoop T is cut at the cutting position to separate the hoop T into independent terminals t. The each terminal t is inserted into the cavity s of the connector.

The mechanism for feeding the terminal t is realized by a method with which a feeding claw is used to hook a feeding hole formed in the elongated portion of the hoop so that the feeding claw is moved.

In the process for inserting the terminal t separated from the hoop T by the cutting mechanism, the rear end of the terminal t temporally inserted into the cavity s of the connector C engaged as described and placed on a pallet P is, as shown in FIG. 38, relatively pressed by a tapered surface 251 of a tapered guide plate 250 disposed in the line feeding direction during movement of the pallet P. Thus, the rear end of the terminal t is inserted into the engaging stopper of a metal lance.

The mechanism for feeding the terminal hoop T and the inserting process, however, suffers from the following problems.

The mechanism for feeding the terminal hoop incorporates the feeding claw feeds the hoop by poking the inner wall of the feeding hole by the leading end thereof from a diagonal direction. Therefore, the feeding claw is slid and undesirably discharged from the hole after the feeding speed has been raised. Thus, there arises a problem in that the hoop T overruns and, therefore, the hoop T cannot be stopped at a predetermined cutting position. Therefore, there arises a problem in that the terminal t cannot be separated from the hoop T because of incorrect position cut by the cutting blade. Another problem arises in that the terminal t to which an excess of the hoop has been allowed to adhere is separated.

To prevent overrunning of the hoop T, a braking mechanism for pressing the surface of the hoop is provided. The high movement speed results in deviation of timing or insufficient pressure. Thus, the braking action cannot satisfactorily be performed.

The process for inserting the terminal t is performed such that the foregoing tapered guide plate 50 rubs the rear end of the terminal t. Therefore, the terminal t is undesirably deformed or broken. In another case, the terminal t cannot sufficiently be inserted.

SUMMARY OF THE INVENTION

A first object of the present invention is to enable the terminal hoop to be cut at an accurate position and the terminal to be separated into a predetermined shape. A second object is to enable insertion of the terminal separated from the hoop into the cavity to be performed accurately without insufficient degree of insertion.

To achieve the first object, a feeding mechanism for feeding a terminal hoop causes a feeding pin to be downwards inserted into a hoop insertion hole formed in a direction in which the hoop is fed so that the feeding pin is moved in the feeding direction.

Thus, the feeding pin completely hooks the hoop so as to completely restrain the hoop in the feeding direction. Therefore, overrunning of the hoop can reliably be prevented. Hence it follows that the hoop can reliably be stopped at the predetermined position so that accurate cutting of the hoop and separation of the terminal are permitted.

A holding pin for holding the hoop is downwards inserted into the insertion hole formed at a position different from a position at which the feeding pin is inserted prior to insertion and removal of the feeding pin. Thus, insertion and removal of the feeding pin can be performed in a state where the hoop is completely secured by the hoop holding pin. Therefore, further accurate feeding of the hoop, that is, accurate cutting and separation of the hoop can be prevented.

Means for inserting/removing the feeding pin with respect to the corresponding insertion hole, and means for inserting/removing the holding pin with respect to the corresponding insertion hole may be connected to each other by a linking mechanism such that alternate insertion and removal of the holding pin and the feeding pin with respect to the corresponding insertion hole are permitted. Thus, the two means can be operated by one operating source. As a result, reduction in the size of the apparatus and saving of power consumption are permitted.

To achieve the second object, the present invention may have a structure that the terminal insertion mechanism places the terminal separated from the hoop by the terminal inserting mechanism on a retaining surface, the height of which is the same as the surface of the bottom of the cavity, and causes an insertion pin arranged to move in a direction in which the terminal is inserted to push the rear surface of the terminal from just behind to insert the terminal. Thus, deformation and breakage of the terminal can be prevented, causing the terminal to accurately be inserted.

The cutting mechanism is structured such that a locating pin is downwards inserted into the insertion hole adjacent to a position at which the cutting blade acts on the terminal prior to acting of the cutting blade on the terminal. Thus, cutting can be performed after the hoop has completely been stopped, causing the hoop to accurately be cut and the terminal to accurately be separated.

Each of the foregoing mechanism may be formed such that an operating mechanism of each of the mechanism for feeding the terminal hoop, the cutting mechanism and the terminal inserting mechanism is constituted by a cam and link mechanism, and one operating shaft is commonly used as operating shafts of the mechanisms. Thus, the three mechanisms can be operated by one operating shaft. As a result, reduction in the size of the apparatus, decrease in the number of elements and saving of power consumption can be realized.

The structure may comprise: a terminal mounting machine for mounting a terminal on a connector; and a pressing machine, in series, disposed at a downstream position of the terminal mounting machine, wherein the terminal mounting machine is the above-mentioned machine for mounting a connector terminal. Thus, the size can be reduced as compared with that of the conventional apparatus. Thus, an apparatus for manufacturing a wire harness can be obtained which requires smaller power consumption and which is able to manufacturing the wire harness exhibiting a high quality at a satisfactory manufacturing yield.

BRIEF DESCRIPTION OF THE DRAWINGS

FIGS. 35A to 35C show the operation for engaging the connector housing, in which FIGS. 35A and 35B show a state before engagement, and FIG. 35C shows a state after the engagement.

DETAILED DESCRIPTION OF THE PREFERRED EMBODIMENTS

Figure 34:
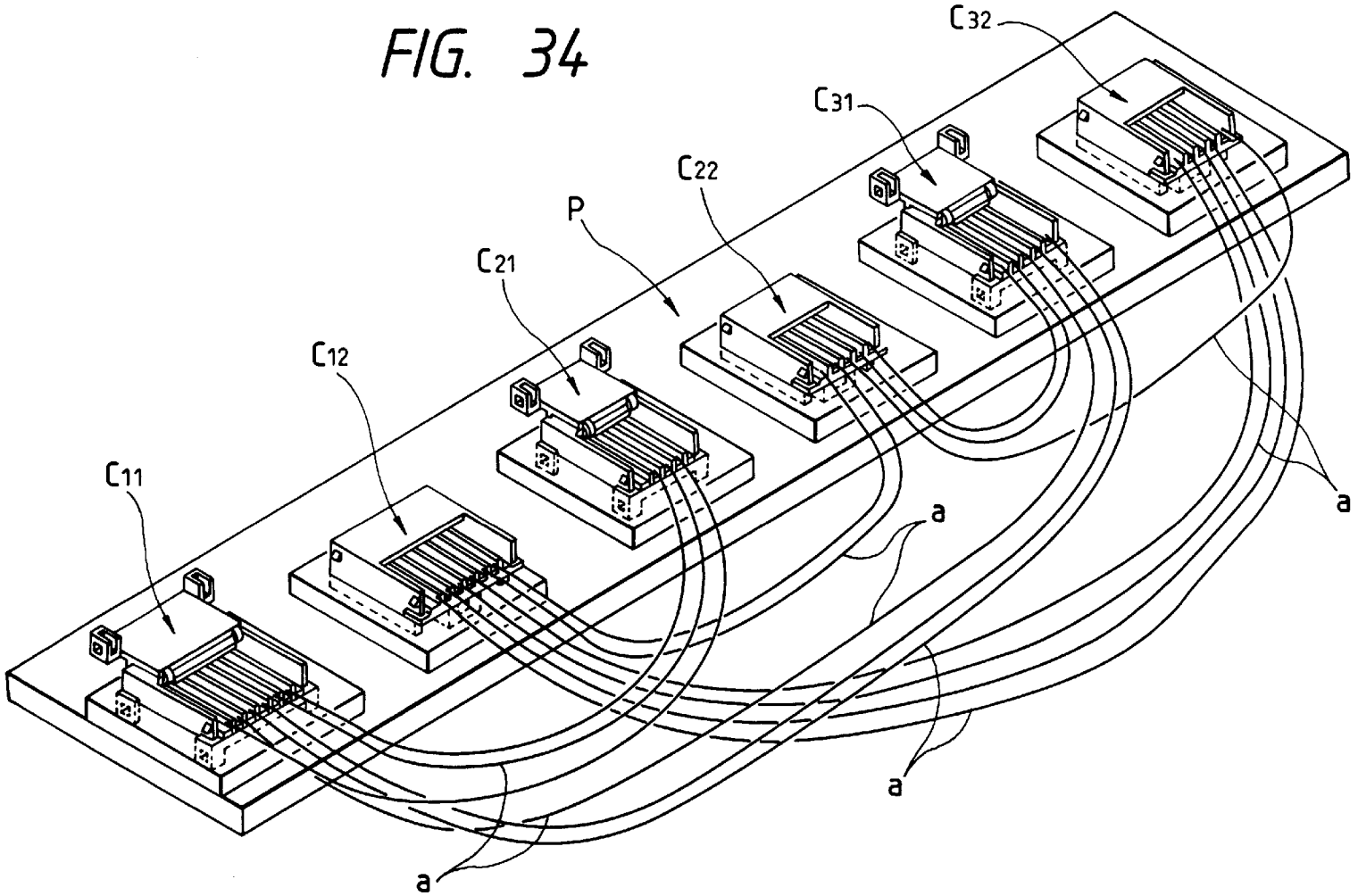
FIG. 34 is a perspective view showing a pallet.
Figure 35A:
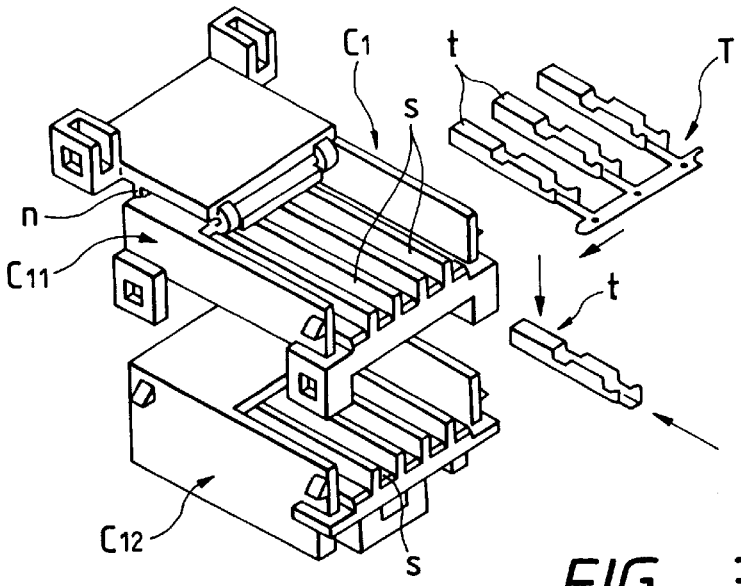
Figure 35B:
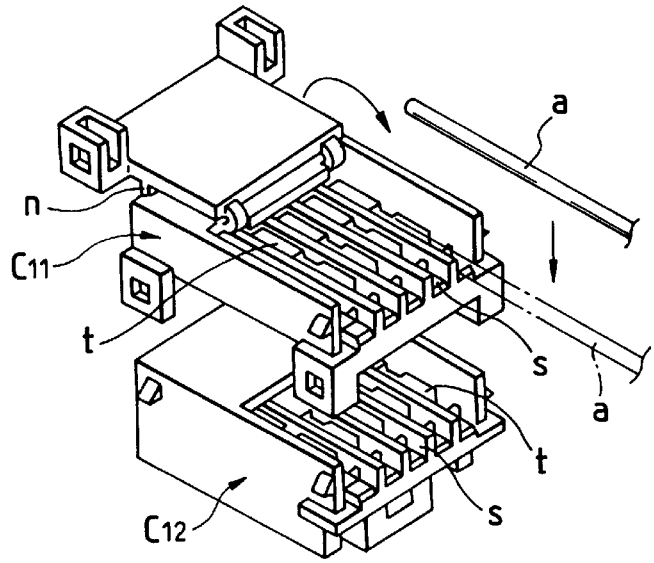
Figure 35C:
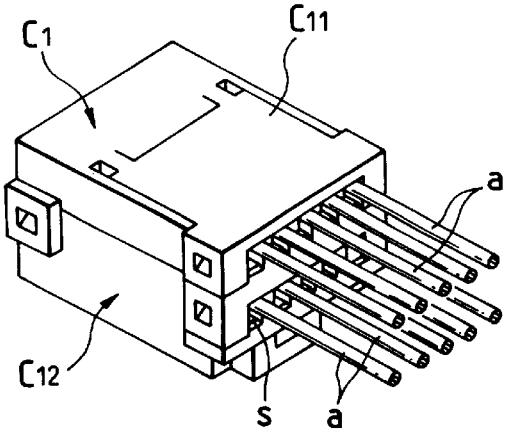
Figure 36:
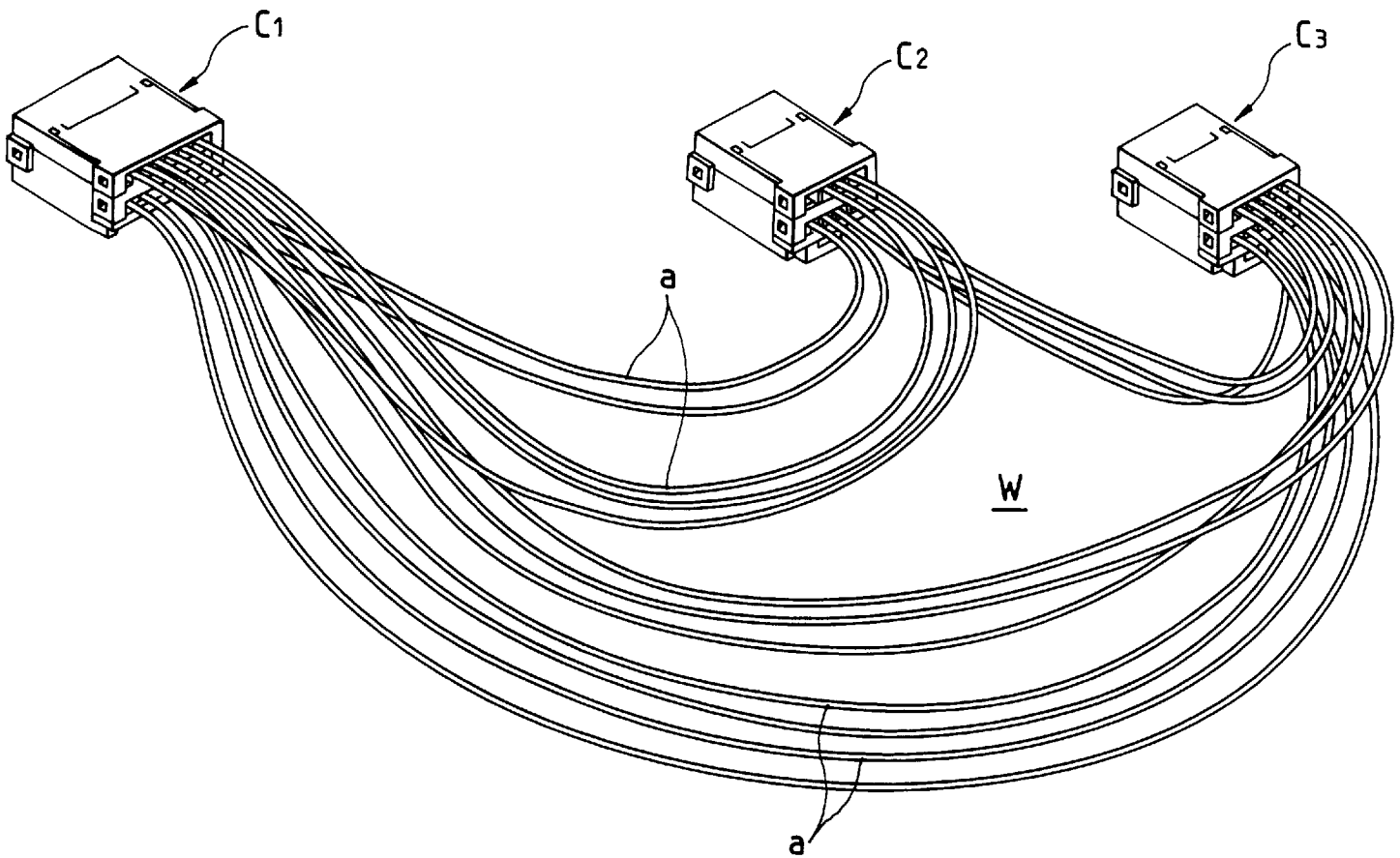
FIG. 36 is a perspective view showing an example of a wire harness.
Figure 37:
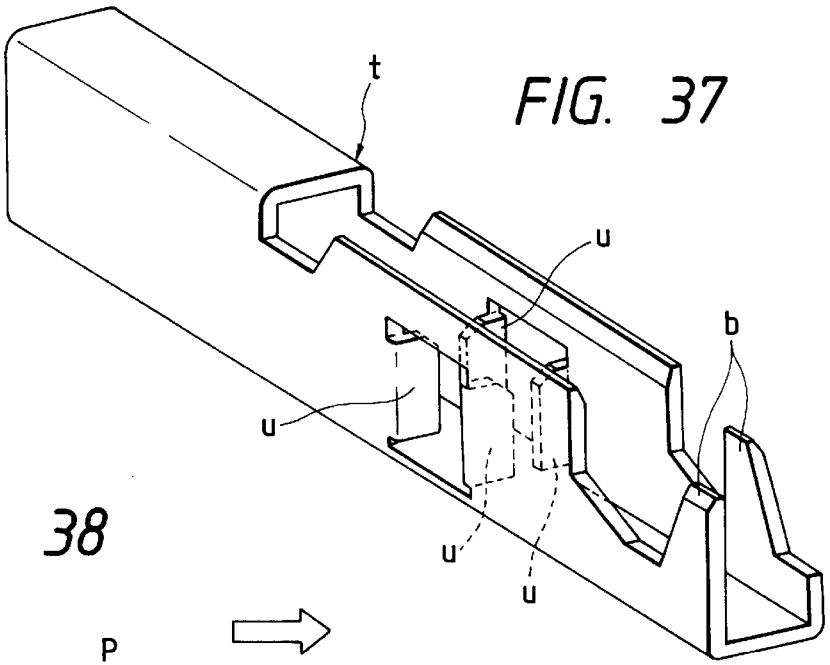
FIG. 37 is a perspective view showing a terminal.

Referring to the drawings, an embodiment of the present invention will now be described. The same elements as those of the conventional structure are given the same reference numerals and the same elements are omitted from description. The terminal t shown in FIG. 37 is mounted on the lower connector housing C12 shown in FIG. 35 and composed of the upper connector housing C11 and the lower connector housing C12. Then, the electric wire a is connected to the terminal t as shown in FIG. 34. Then, the two housings C11 and C12 are engaged to each other as shown in FIG. 36 so that the wire harness W is obtained.

Figure 1:
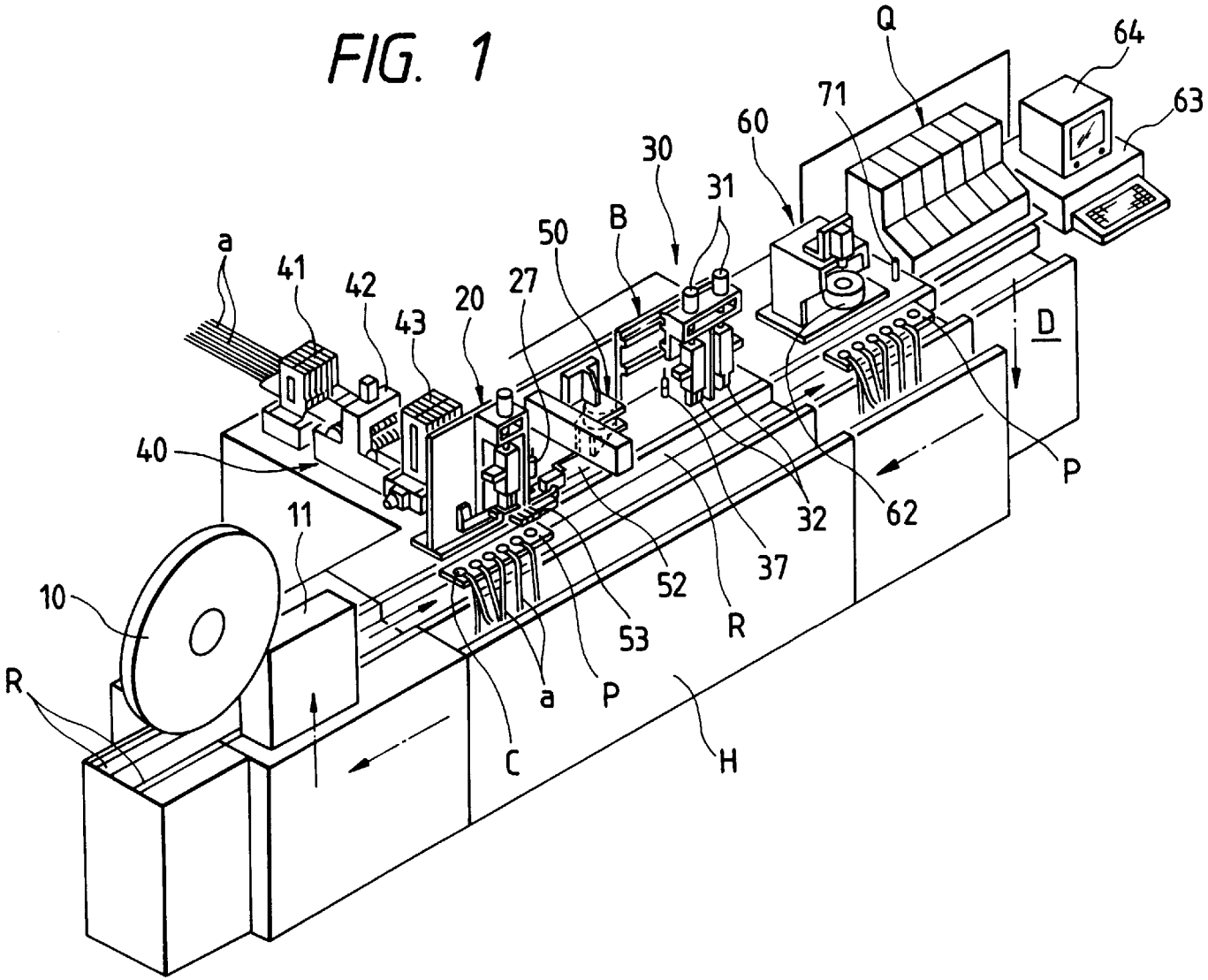
FIG. 1 is an overall schematic perspective view showing an embodiment.

FIG. 1 is a line for manufacturing the wire harness W according to the present invention. The lower left portion of FIG. 1 is the upstream portion of the line, while the downstream portion is the downstream portion. The manufacturing line incorporates rails R laid on a frame H. The following units are in series disposed along the rails R in the following order: a terminal mounting machine A for mounting the terminal t on the connector (housing) C; a wire pressing unit B for pressing the electric wire a against the terminal t; and an inspecting and assembling unit E for inspecting the appearance of result of pressing and mounting a connector cover (engaging the upper connector housing C11). A setting portion D for the lower connector housing C12 and a stocker Q for the upper and lower housings C11 and C12. The manufacturing line incorporates the foregoing units. The structure and operation of each unit will now be described sequentially as the manufacturing process proceeds.

Each connector (each housing) C in the stocker Q is, in the setting portion D, manually engaged to (placed in) a recess of the pallet P shown in FIG. 34. Then, a lifter and a conveyor (not shown) are operated to convey the connector C in the frame H as indicated with a dashed-line arrow shown in FIG. 1 to move the connector C to the terminal mounting machine A.

Figure 2:
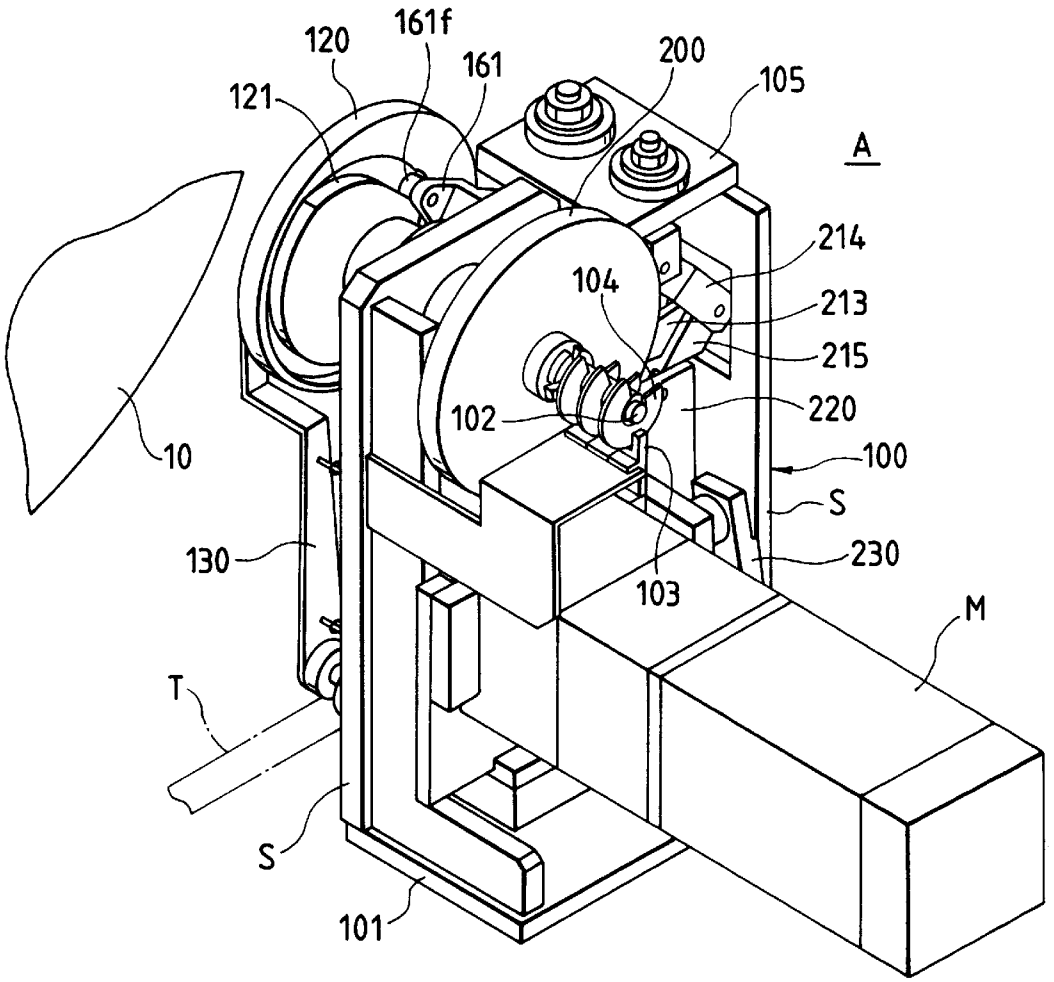
FIG. 2 is a schematic perspective view showing a terminal mounting machine.

The terminal mounting machine A incorporates a reel 10 around which the terminal hoop T has been wound; and a terminal cutting/inserting unit 100. FIG. 2 is an enlarged schematic perspective view showing the terminal cutting/inserting unit 100. The terminal hoop T is fed from the reel 10 to the terminal cutting/inserting unit 100 by a cam and link mechanism which is operated by a motor M. In the terminal cutting/inserting unit 100, the terminal hoop T is separated into terminals t by cutting so as to be inserted into a cavity formed at a predetermined position in the connector C. Elements of the terminal cutting/inserting unit 100 are disposed above a base plate 101 secured to the upper surface of the frame H of the apparatus, the base plate 101 and a stand S having a surface disposed in parallel with the line and stood erect on the floor. The detailed structure and operation of the terminal cutting/inserting unit 100 will now be described with reference to FIGS. 3 to 11, 19 and 20.

Figure 3:
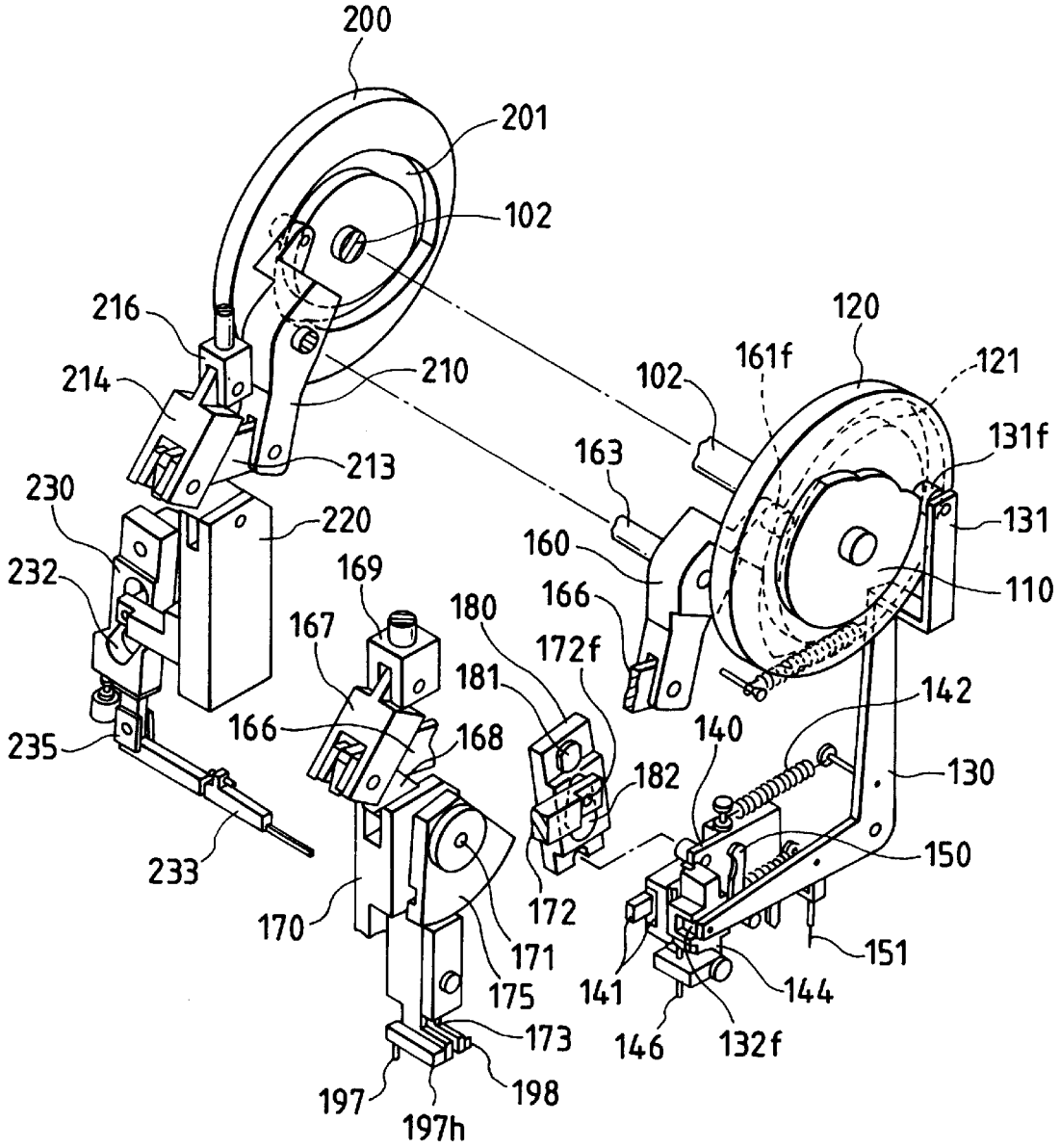
FIG. 3 is an exploded perspective view showing the terminal mounting machine.
Figure 4:
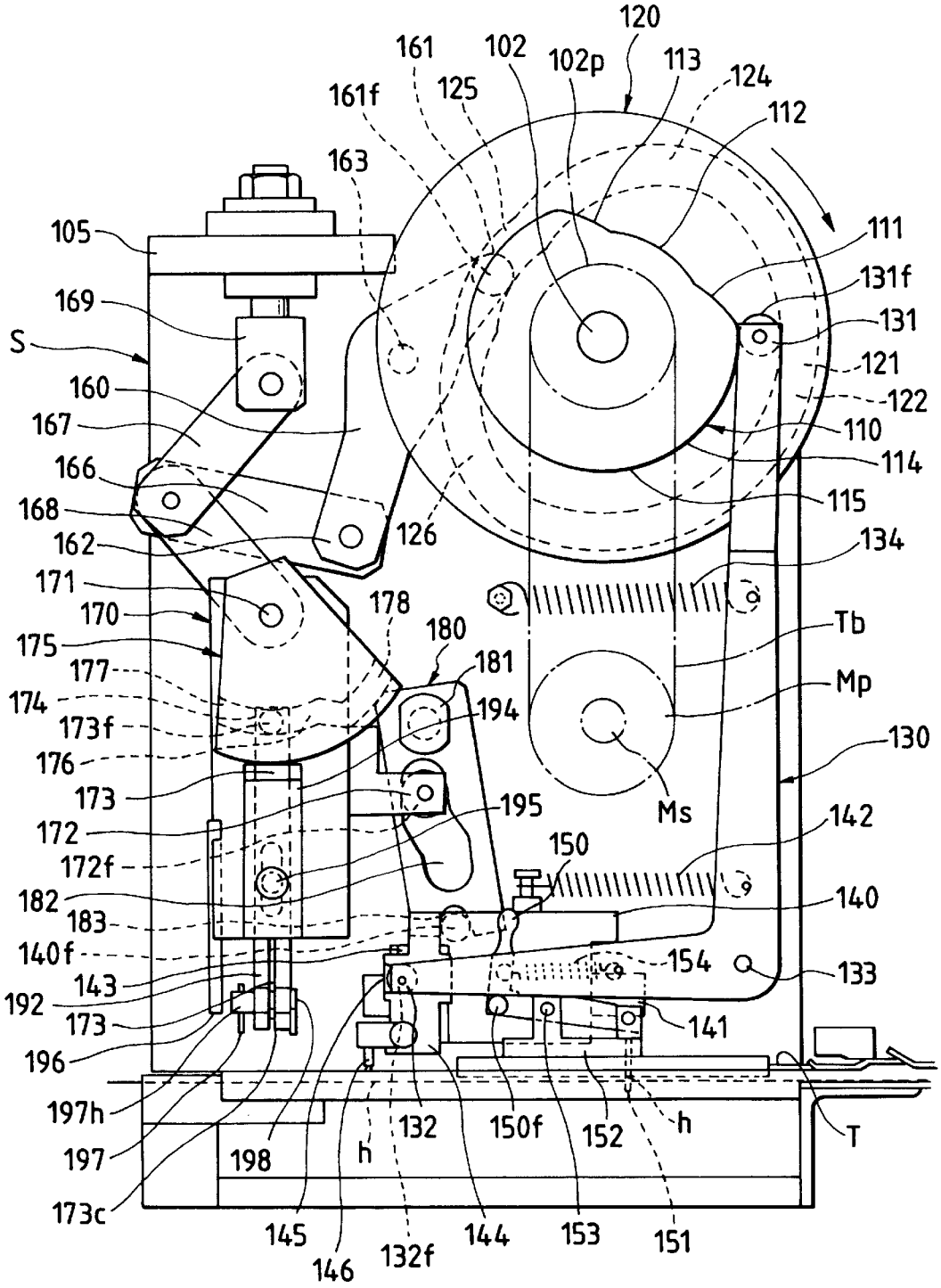
FIG. 4 is a rear view showing the terminal mounting machine.
Figure 7:
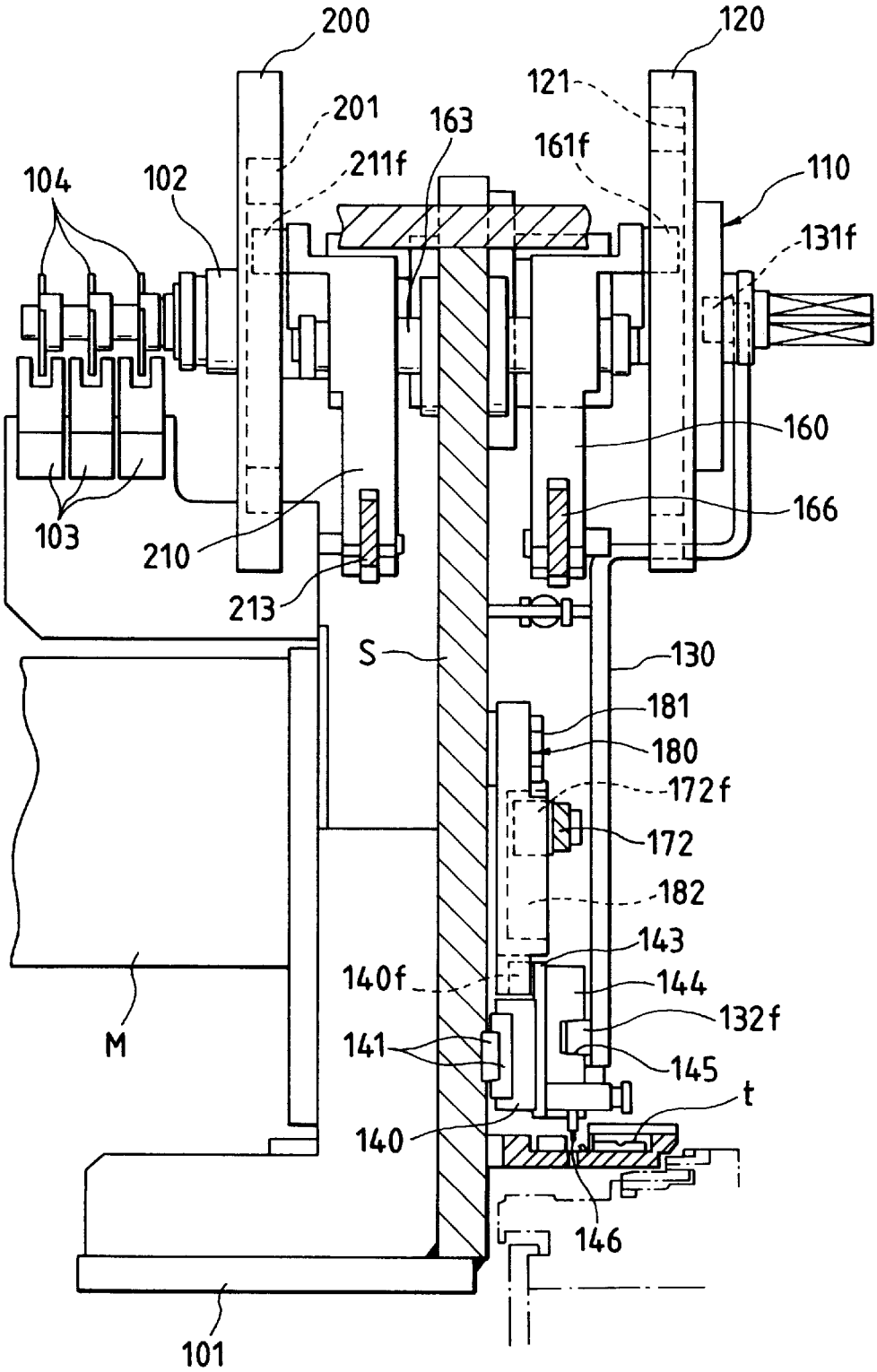
FIG. 7 is a right-hand side view showing the terminal mounting machine.

FIG. 3 is an exploded perspective view showing the unit 100 when the unit 100 is viewed from a position behind the line. To simplify the illustration, the stand S and the motor M are omitted from illustration. FIG. 4 is a rear view and FIG. 7 is a right-hand side view. As shown in FIGS. 3 and 4, a rotation center 102 is horizontally pivoted at a diagonally upper right position in the upper portion at the rear of the stand S such that the rotation center 102 penetrates the stand S. As shown in FIG. 7, three plate cams 110, 120 and 200 are joined to the cam shaft 102 in a direction starting with the right-hand portion of FIG. 7. That is, the hoop feeding/holding cam 110, the hoop locating/cutting cam 120 disposed in contact with the rear surface of the hoop feeding/holding cam 110 and the terminal-inserting plate cam 200 are disposed, the terminal-inserting plate cam 200 being disposed such that the stand S is interpposed.

Figure 5:
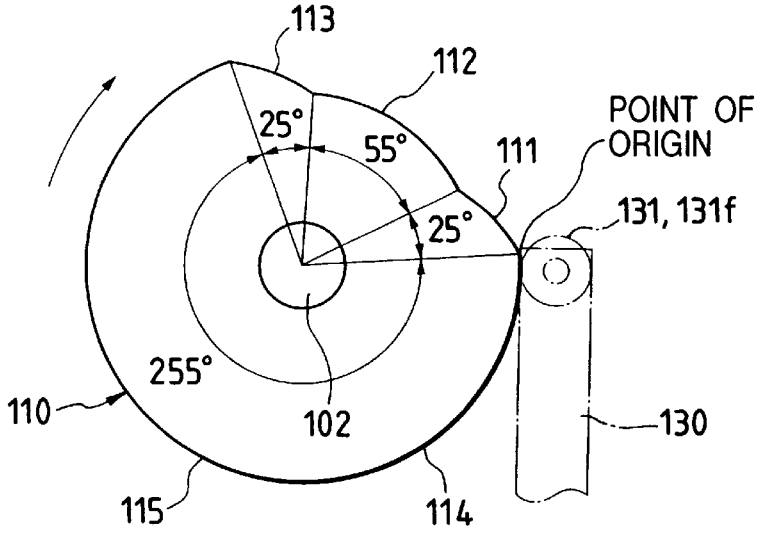
FIG. 5 is a front view showing a hoop feeding cam.

The first unit, which is the hoop feeding/holding cam 110, as shown in FIG. 5, has the outer surface which is a cam surface 114. The cam surface 114 is formed into a connected structure composed of a partial circle 115 having an angle of 255° and three partial curves 111, 112 and 113 having the residual angle, formed inner than the outer surface of the partial circle 115 and projecting outwards. The partial curves 111, 112 and 113 are formed symmetrically with respect to a line connecting the center of the central partial curve 112 and the rotational shaft 102. Each of the partial curves 111 and 113 has an angle of 25°, while the partial curve 112 has an angle of 55°. The distance from each of the partial curves 111, 112 and 113 to the center of rotation of the cam 110 (the center of the cam shaft 102) is shorter than the radius of the partial circle 115. The distance of the partial curve 111 is gradually shorter than the radius of the partial circle 115 along the counterclockwise direction in FIG. 5. The distance of the central partial curve 112 from the center of rotation 102 is always the same as the distance at the boundary with the partial curve 111. The distance of the partial curve 113 is gradually elongated from the value at the boundary with the central partial curve 112. The foregoing distance is the same as the radius of the partial circle 115 at the boundary with the partial circle 115.

An end 131 of a hoop-feeding link 130 formed into an inverted L-shape is in contact with the cam surface 114 of the hoop feeding/holding cam 110 through a cam follower **131*f* joined to the cam surface 114, as shown in FIG. 4. The hoop-feeding link 130 is, in the inverted L-shape bent portion thereof, swingably joined to a horizontal rotational shaft 133 pivotally supported by the stand S. A spring 134 arranged between the central portion of an inverted L-shape vertical side 131 and the stand S urges the cam follower 131*f* so as to always brought into contact with the cam surface 114 of the cam 110. A cam follower 132*f* is as well as joined to another end 132 (the lower end of the inverted L-shape) of the hoop-feeding link 130. The cam follower 132*f* is engaged to a cam groove 145 of a feeding-pin holder 144** to be described later.

Figure 8:
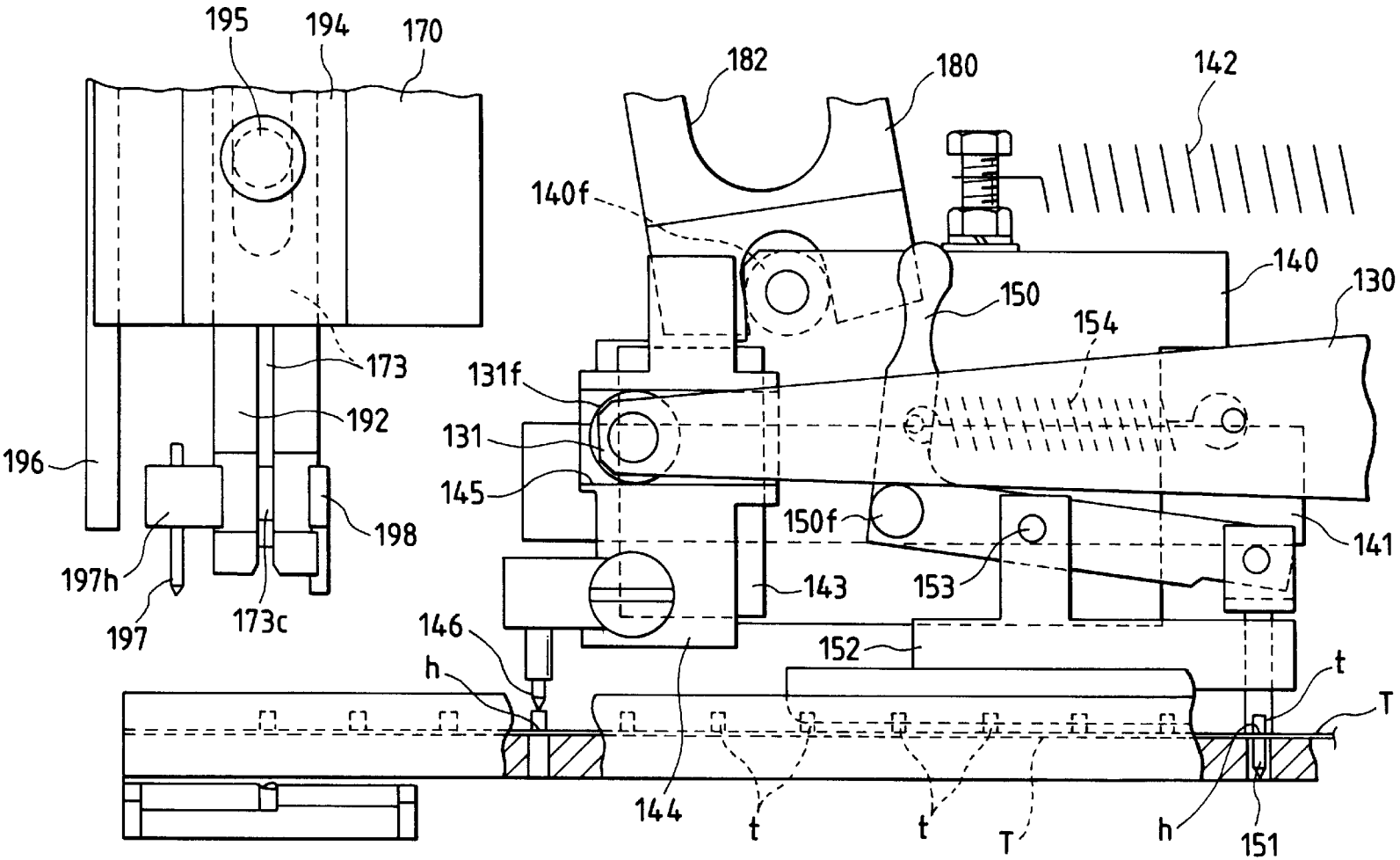
FIG. 8 is an enlarged view showing an essential portion shown in FIG. 4.

A feeding plate 140 capable of horizontally sliding along a linear guide 141 secured to the surface of the stand S is disposed at the rear of the inverted L-shape lower side of the hoop-feeding link 130 as shown in FIG. 4 and FIG. 8 which is an enlarged view of the lower portion shown in FIG. 4. A spring 142 is arranged between the feeding plate 140 and the hoop-feeding link 130 so that the feeding plate 140 is always urged in a direction (to the right in the drawing) opposite to the direction in which the hoop T is fed. A vertical feeding-pin holder 144 capable of sliding along a linear guide 143 provided for the feeding plate 140 is joined to the left-hand portion of the feeding plate 140 in FIG. 4 (or FIG. 8). A horizontal cam groove 145 is provided for the feeding-pin holder 144. As described above, the cam follower **132*f* of the other end 132 of the hoop-feeding link 130 is engaged to the cam groove 145. A feeding pin 146 for feeding the terminal hoop T facing downwards is provided for a projecting lower surface in the lower left portion of the feeding-pin holder 144**.

As shown in FIGS. 4 and 8, an L-shape lever 150 is lengthwise disposed between the inverted L-shape lower side of the hoop-feeding link 130 and the feeding plate 140. The lever 150 is arranged to hold a hoop holding pin 151, the lever 150 being joined to a guide shaft 153 of a guide block 152 provided for the base plate 101 at an intermediate position of the L-shape bottom portion such that the lever 150 is able to swing in the vertical plane of the guide shaft 153. The holding pin 151 is swingably joined to the leading end of the bottom side of the L-shape portion. The reason why the holding pin 151 is made to be swingable will now be described. Since the lever 150 performs seesaw motion about the guide shaft 153 to change the angle at which the holding pin 151 is joined, the holding pin 151 which must vertically be inserted into an insertion hole in the hoop T must be caused to face vertically owing to its deadweight.

A cam follower **150*f* is joined to an L-shape bent portion of the lever 150, the cam follower 150*f* being in contact with the lower surface of the inverted L-shape bottom side of the hoop-feeding link 130. Also a spring 154 is arranged between the L-shape vertical side of the lever 150 and the stand S so that the lever 150 is always clockwise urged around the guide shaft 153**.

Figure 6:
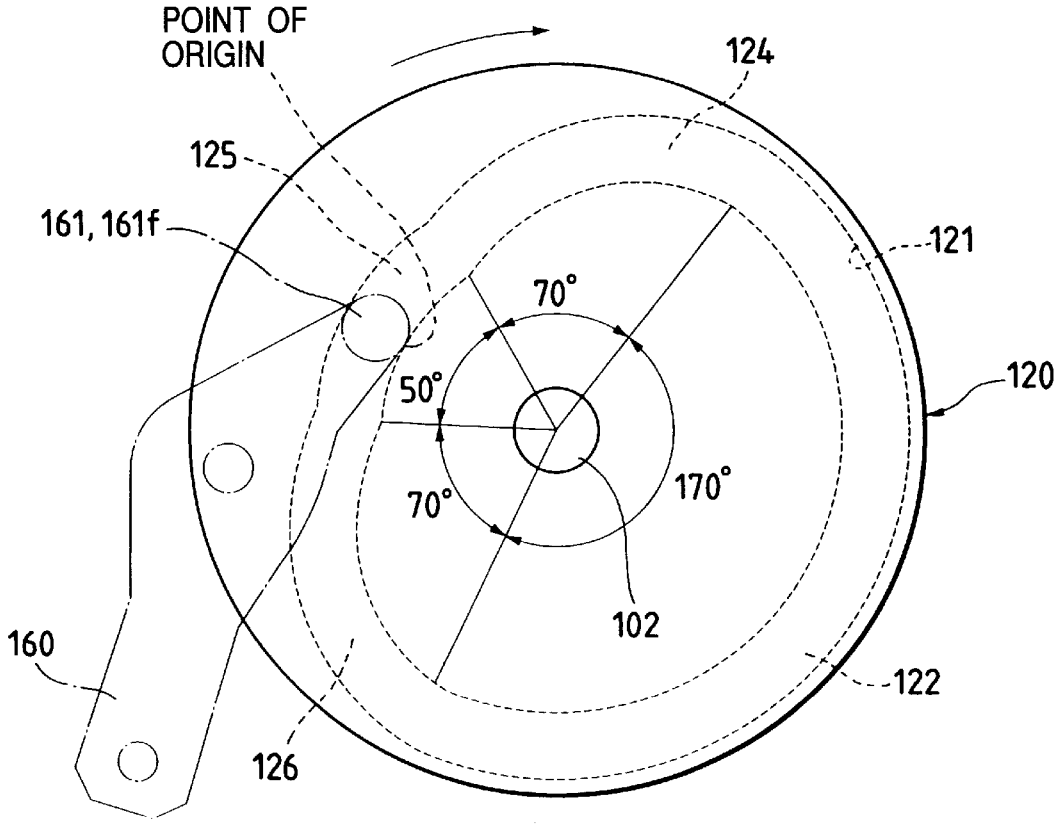
FIG. 6 is a rear view showing a hoop locating/cutting cam.

The second hoop locating/cutting cam 120 is, as shown in FIGS. 4 and 6, formed into a disc shape having a front portion (the front portion of the line and a rear portion in FIGS. 4 and 6) provided with a cam groove 121 as indicated with a dashed line. The cam groove 121 is, as shown in FIG. 6, composed of a partial circle 122 having an angle of 170°. The residual angle of the cam groove 121 is formed by three partial curves 124, 125 and 126 projecting outwards. The three partial curves 124, 125 and 126 are symmetrical with respect to a line connecting the center of the central partial curve 125 and the rotation center (the center of the rotation center 102) of the cam 120. Each of the partial curves 124 and 126 makes an angle of 70°, while the partial curve 125 makes an angle of 50°. The distance from each of the partial curves 124, 125 and 126 to the center of rotation of the cam 120 is shorter than the radius of the partial curve 125. The distance from the partial curve 124 to the center of rotation is made to be gradually shorter than the radius of the partial circle 122 along the partial curve 124 in a counterclockwise direction in the drawing. The distance of the partial curve 125 from the center of rotation 102 is always the same as the distance at the boundary with the partial curve 124. The distance of the partial curve 126 is gradually elongated from the value at the boundary with the central partial curve 125. The foregoing distance is the same as the radius of the partial circle 122 at the boundary with the partial circle 122.

As shown in FIG. 4, an end 161 of a link 160 joined to a horizontal rotational shaft 163 pivotally supported by the stand S in parallel with the cam shaft 102 is engaged to the cam groove 121 through a cam follower 161*f*. Anther end 162 of the link 160 is connected to an end of the link 166. Ends of two links 167 and 168 are connected to the other end of the link 166.

The link 167 is, as shown in FIG. 4, rotatively joined to the lower end of an adjust holder 169 having an end secured to a support plate 105 on the upper surface of the stand S. A connecting shaft 171 of a cutting ram 170 is, owing to a key, secured to the other end of the link 168 such that the connecting shaft 171 is secured perpendicular to the surface of the link. An upper end of a cutting ram 170 is rotatively joined to the connecting shaft 171. The cutting ram 170 is joined to a linear guide 179 (see FIG. 9) provided for the rear surface of the stand S such that vertical sliding with respect to the cutting ram 170 is permitted.

The connecting shaft 171 furthermore extends to the rear portion of the line (this side of FIG. 4 and right-hand portion in FIG. 9) from a position at which the cutting ram 170 of the connecting shaft 171 is joined. A plate cam 175 for introducing the terminal is, owing to a key, secured to the extending portion. Therefore, when the link 168 rotates the connecting shaft 171, also the plate cam 175 is rotated. As shown in FIG. 4, the plate cam 175 is formed into a sector shape having a rear surface (the rear portion in FIG. 4 and a front portion of the line) in which a cam groove 176 is formed. The cam groove 176 is formed by connecting central and outer partial curves 177 and 178 formed in parallel with the outer surface of the section shape.

Figure 9:
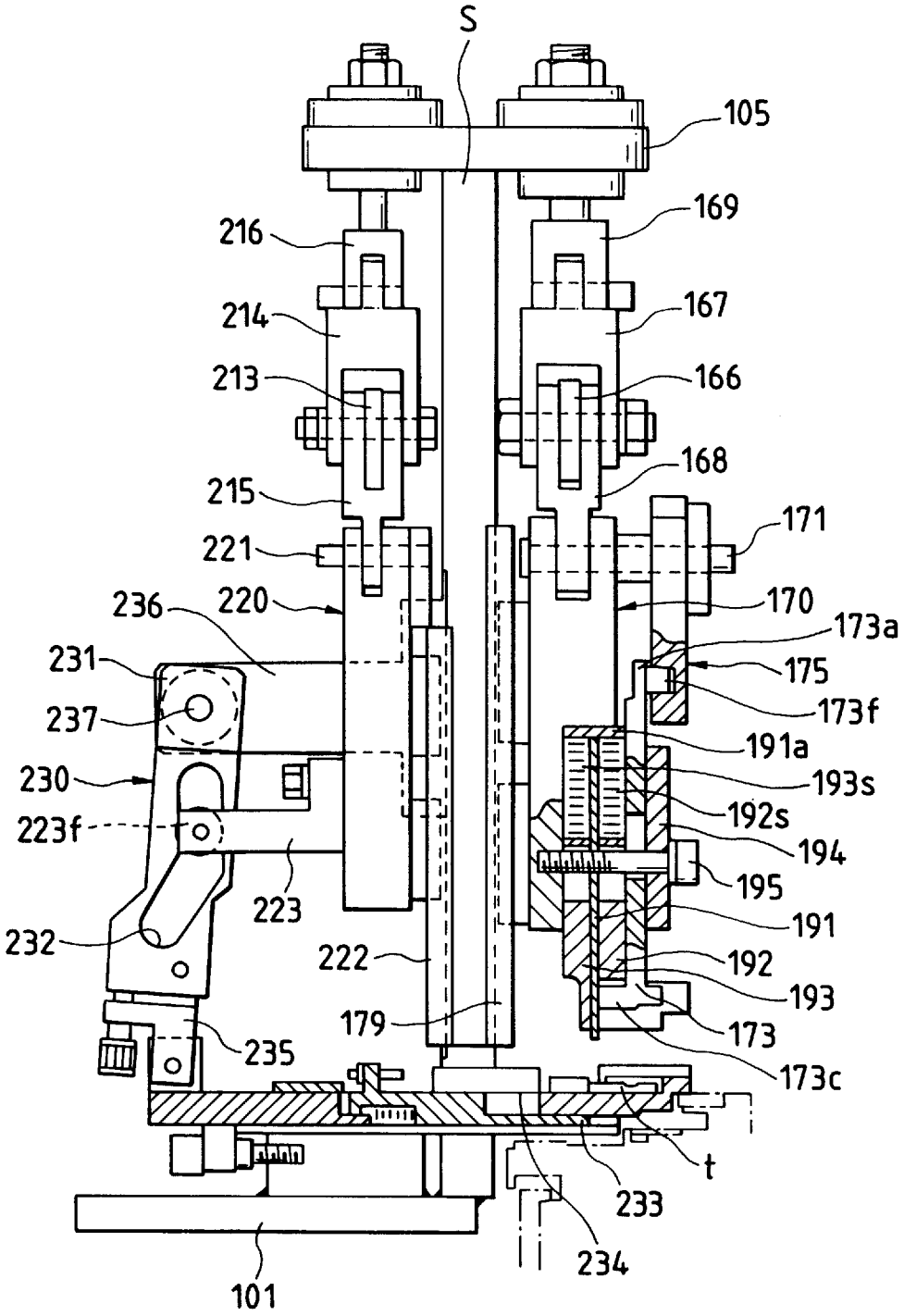
FIG. 9 is a left-hand side view showing the terminal mounting machine.
Figure 10:
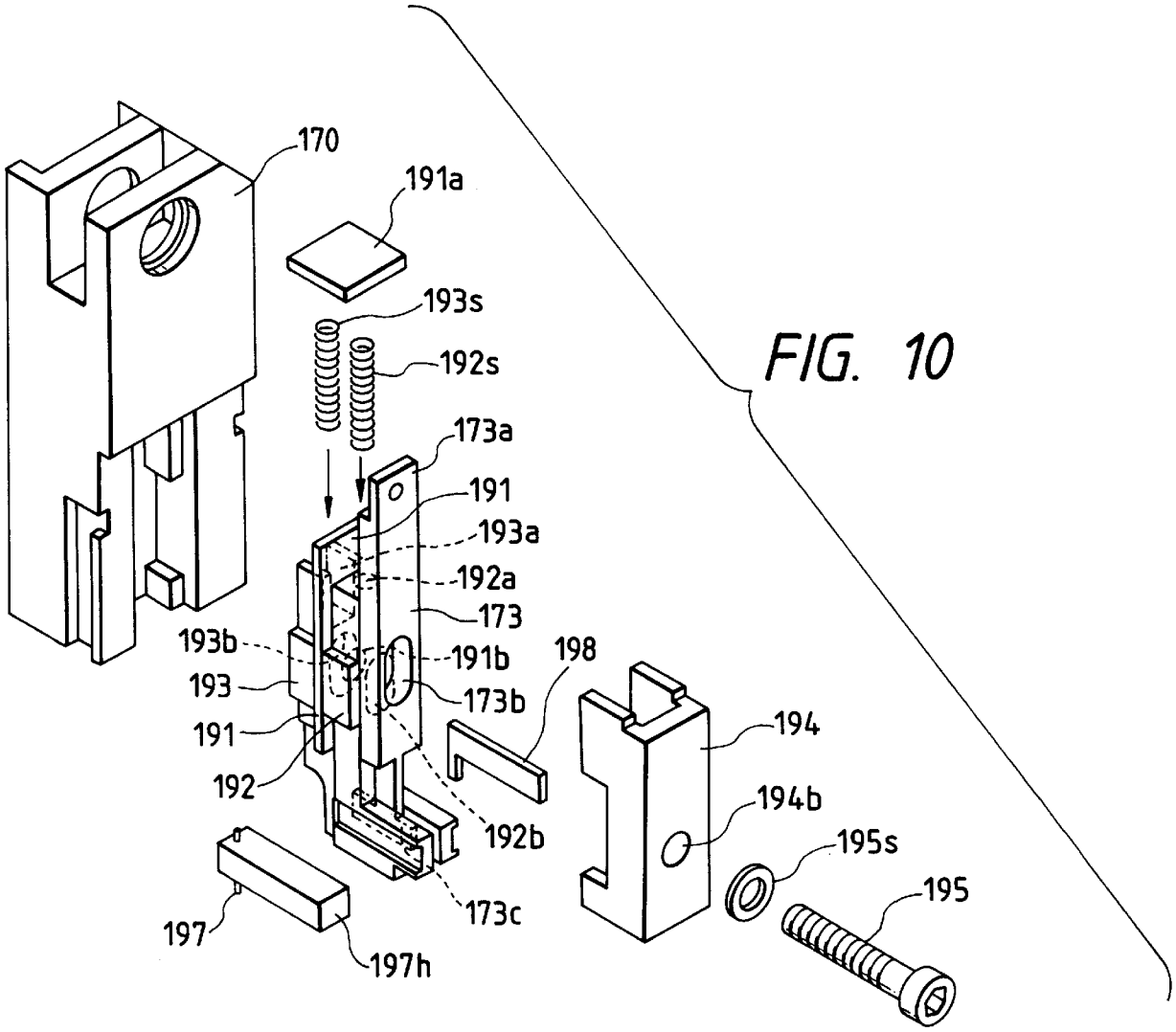
FIG. 10 is an exploded perspective view showing a terminal cutting portion.

An upper end 173*a* of a terminal introducing guide 173 constituted by an elongated member is joined to the cam groove 176 through a cam follower 173*f*. As shown in FIG. 9 which is a cross sectional view and FIG. 10 which is an exploded perspective view, a terminal-cutting upper blade 191 sandwiched between an elongated terminal locator 192 and a pad 193 is inserted into the cutting ram 170 at the rear (the front portion of the line) of the terminal introducing guide 173. A guide cover 194 covers the front surface portion (the rear portion of the line) of the terminal introducing guide 173. The terminal-cutting upper blade 191 is joined to the cutting ram 170 by bolts 195. Reference numeral 195s represents a washer.

The terminal locator 192 has a lower end provided with a horizontal projection (projecting to the rear portion of the line and right-hand direction in FIG. 9). The projection is branched into two sections to cover the terminal t when the cutting ram 170 has downwards been moved to separate the terminal t by cutting. Thus, the terminal locator 192 traverses the terminal t in the widthwise direction so as to restrain the terminal t in the widthwise direction. The pad 193 sandwiches the terminal-cutting upper blade 191 in the direction of the thickness in cooperation with the terminal locator 192 so as to vertically support the terminal-cutting upper blade 191. The terminal locator 192 and the pad 193 have upper portions each of which is provided with a spring-inserting hole 192*a* and a recess 193*a*. In a state shown in FIG. 9, the springs 192*s* and 193*s* have been inserted into the foregoing portions. The two springs 192*s* and 193*s* are enclosed in the cutting ram 170 by a spring cover 191*a* placed on the upper end of the terminal-cutting upper blade 191. The terminal locator 192 slides between the terminal introducing guide 173 and the terminal-cutting upper blade 191, while the pad 193 slides between the inner surface of the cutting ram 170 and the terminal-cutting upper blade 191. Therefore, bolt insertion holes 173*b*, 192*b* and 193*b* of the terminal introducing guide 173, the terminal locator 192 and the pad 193 are formed into elongated holes. On the other hand, circular holes 194*b* and 191*b* of the guide cover 194 and the terminal-cutting upper blade 191 are formed into circular holes.

As shown in FIG. 4, a hoop-cutting upper blade 196 is joined to the lower portion of the left-hand side of the cutting ram 170. A locating pin 197 is, through a locating-pin holder 197*h*, joined to the left-hand surface at the lower end of the terminal locator 192 through a locating-pin holder 197*h*. The locating pin 197 is joined to be located just above the insertion hole h of the hoop T when the fed hoop T has been stopped at a predetermined position. A hoop guide 198 is joined to the right side at the lower end of the terminal locator 192. When the terminal locator 192 has been moved to the lowest position (bottom dead center), the lower surface of the hoop guide 198 presses the upper surface of the hoop T. Thus, upward looseness of the hoop T can be prevented.

As shown in FIG. 4, an elongated cam arm 180 is joined to the right of the cutting ram 170 such that the cam arm 180 is able to rotate around a horizontal shaft 181 pivotally supported by the stand S. A cam groove 182 is formed in the rear surface (the front surface in the drawing) of the cam arm 180. The cam follower 172*f* formed at the leading end of the projection 172 provided for the right-hand surface of the cutting ram 170 as shown in FIG. 4 is engaged to the cam groove 182. As shown in the drawing, the cam groove 182 forms a passage structured such that an upper left straight portion and a lower right straight portion are connected to each other by an intermediate and diagonal straight portion.

A groove 183 penetrating the direction of the thickness of the cam arm 180 is formed at the lower end of the cam arm 180, the groove 183 being formed from the lower end toward the center. A cam follower 140*f* provided for the rear surface the front surface in FIG. 4) of the upper portion of the feeding plate 140 is engaged to the groove 183. As described above, the feeding-pin holder 144 is slidably joined to the feeding plate 140 through the vertical linear guide 143. The cam follower 132*f* at the leading end of the hoop-feeding link 130 is engaged to the horizontal cam groove 145 of the feeding-pin holder 144.

The linking mechanism formed from the cutting ram 170 to the feeding plate 140, the feeding-pin holder 144 and the hoop-feeding link 130 through the cam arm 180 causes the hoop feeding/locating operation and the cutting operation to synchronously be performed as described later.

The mechanism for operating the hoop feeding/holding and hoop locating/cutting plate cams 110 and 120 jointed to the rotation center 102 is structured as described above. The third plate cam 200 is provided to insert the terminal. To simplify description, the hoop feeding/holding and hoop locating/cutting operations performed by the hoop feeding/holding and hoop locating/cutting plate cams 110 and 120 will now be described prior to describing the third plate cam 200.

The foregoing operations are performed by a motor M joined to the stand S. A main shaft Ms of the motor M and the cam shaft 102 of the plate cams 110, 120 and 200 are provided with sprockets Mp and 102*p*, respectively. A belt drive operation realized by a timing belt Tb arranged among the sprockets Mp and 102*p* causes rotations of the main shaft Ms of the motor M to be transmitted to the cam shaft 102. Thus, the plate cams 110, 120 and 200 are rotated. Then, rotations of the plate cams 110, 120 and 200 permit feeding, locating and cutting (and inserting of terminal t to be described later) of the hoop T to be performed.

Three photomicrosensors 103 are disposed adjacent to the projecting end of the cam shaft 102 adjacent to the terminal-inserting plate cam 200 shown in FIGS. 2 and 7. In cooperation with the slit plate 104 provided for the projecting portion of the cam shaft 102, confirmation of the emergency stop position, confirmation of the position when an automatic operation is restarted after a manual operation and transmission of a start signal for performing pitch feeding can be performed.

Figure 11:
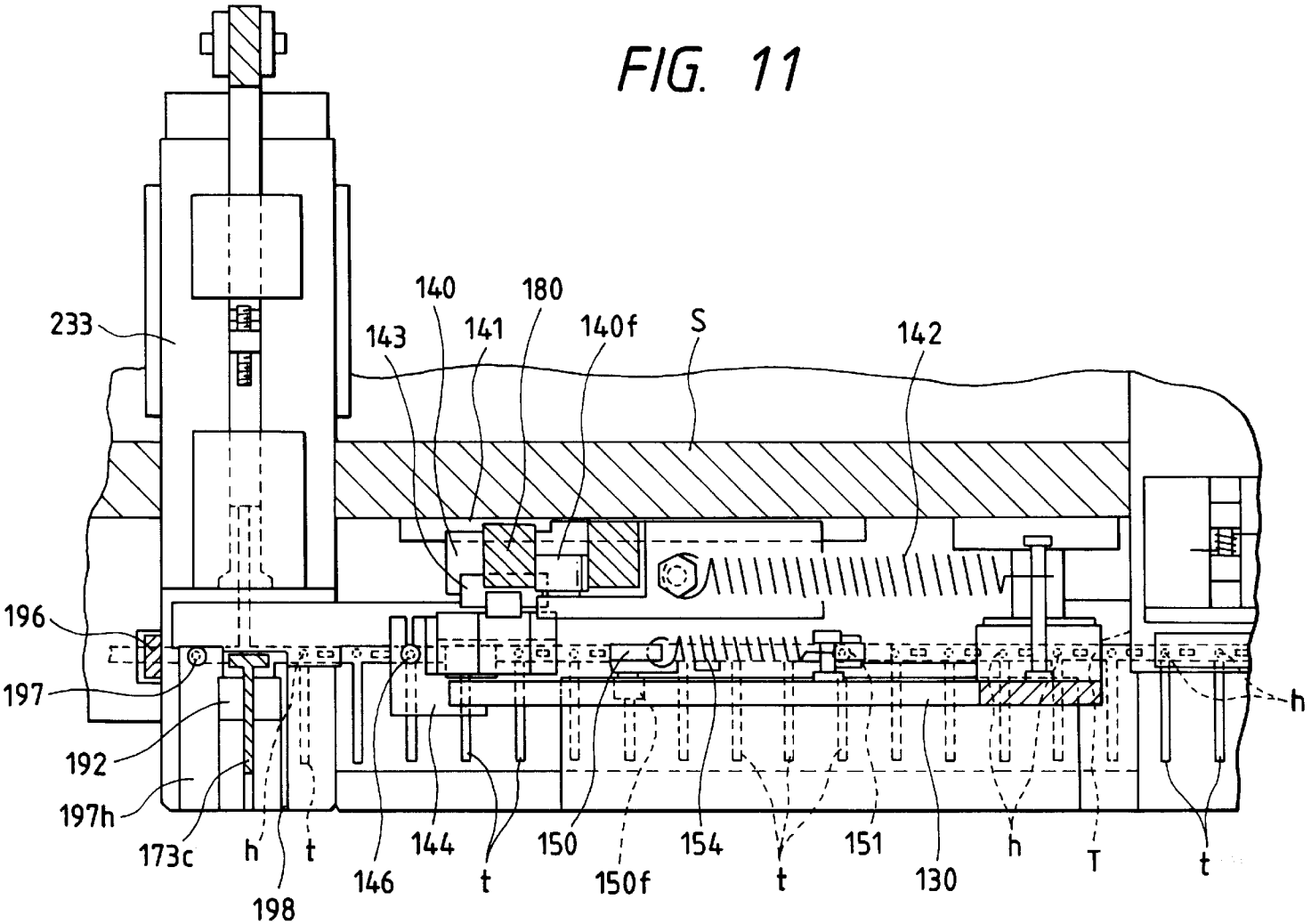
FIG. 11 is an enlarged view showing essential portions of a hoop and the terminal mounting machine in a plan view.
Figure 17:
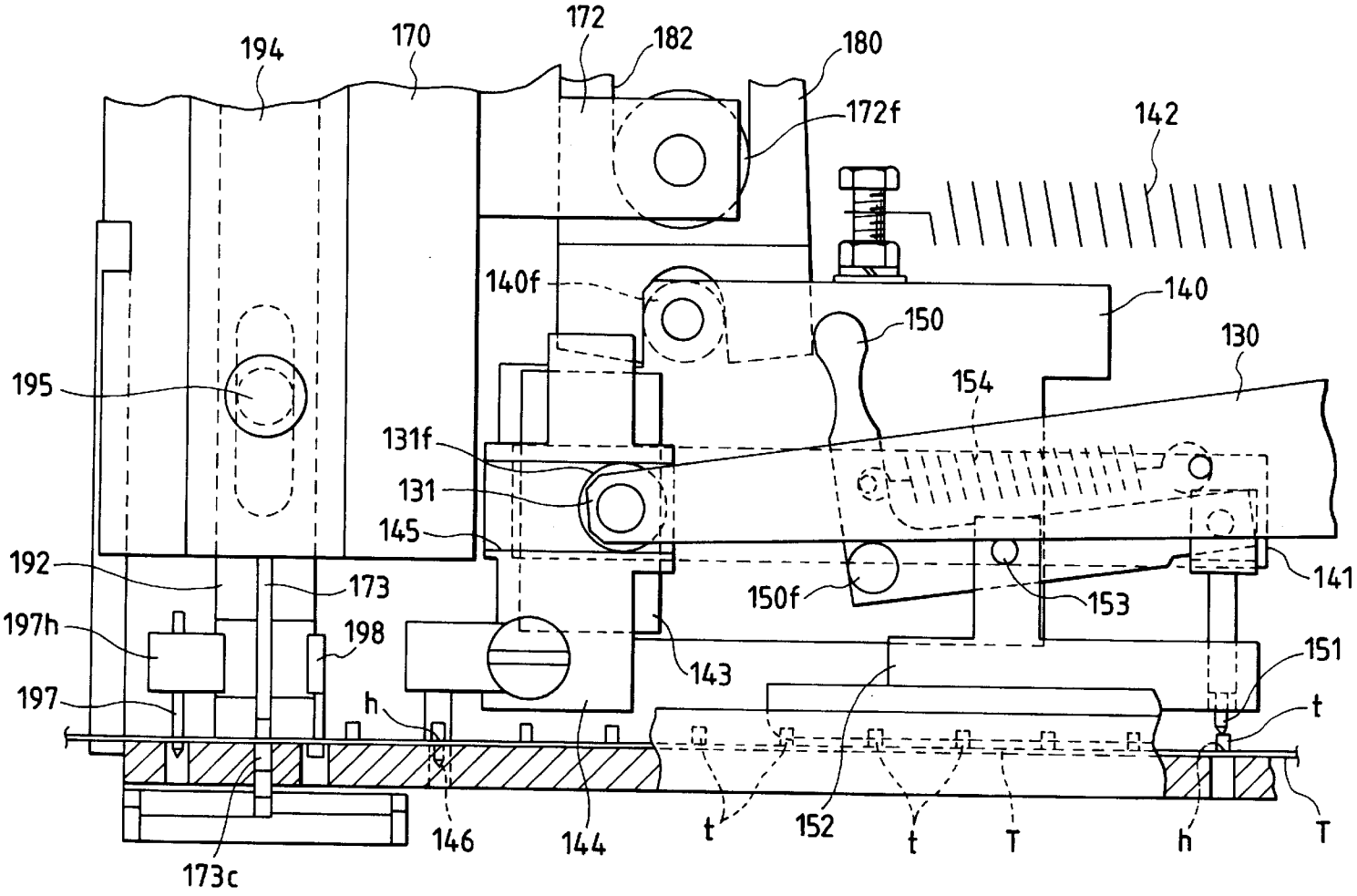
FIG. 17 is a rear view showing an essential portion of a state immediately after the terminal has been separated.
Figure 18:
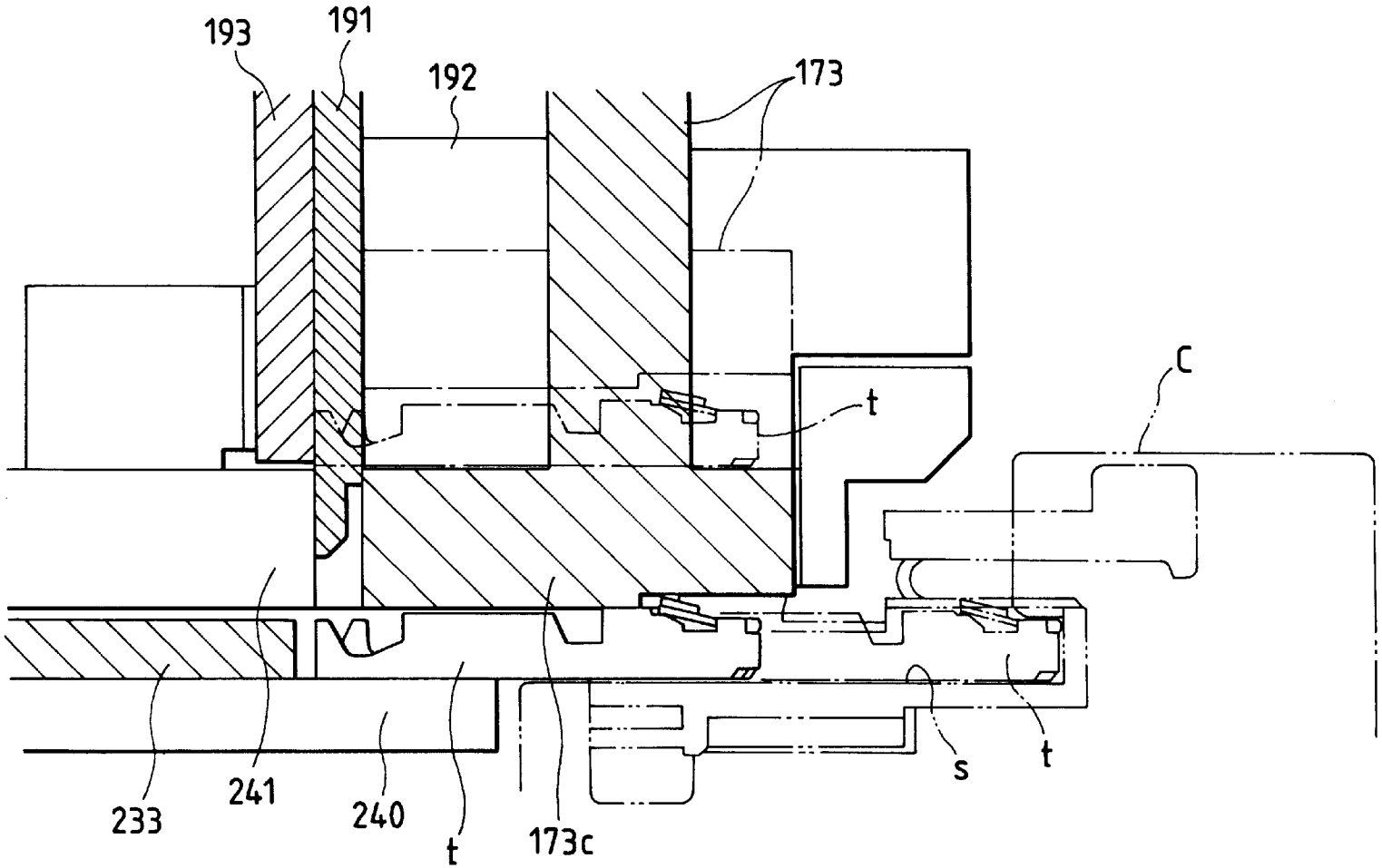
FIG. 18 is an enlarged cross sectional view showing an essential portion of a state immediately after the terminal has been separated by cutting.

The terminal hoop T for use in this embodiment is structured as shown in FIG. 11. Terminals t formed at predetermined pitches in the lengthwise direction of the hoop T and circular holes h into which the holding, feeding and locating pins 151, 146 and 197 are inserted are arranged. The circular hole h has a standard diameter which is slightly larger than the outer diameter of each of the pins 151, 146 and 197. When each pin has been inserted, unintentional movement of the hoop T can be prevented. When the terminal-cutting upper blade 191 or the hoop-cutting upper blade 196 has caused to act on the hoop T in the foregoing state, the terminal-cutting upper blade 191 and the hoop-cutting upper blade 196 can downwards be moved to predetermined positions with a satisfactory accuracy while a predetermined tolerance is being satisfied. Thus, the terminal t can be separated from the hoop T by cutting and the hoop T can be cut. In the drawing, the hoop T is fed from right to the left. The operations for holding, locating and cutting the hoop T will now be described. FIGS. 12 to 16 sequentially show the flow of the operation continuing from FIG. 4. FIG. 17 is an enlarged view showing an essential portion of the hoop feeding/cutting portion. FIG. 18 is a cross sectional view showing an essential portion of a state in which the terminal t has been separated from the hoop by cutting and downwards moved to the surface of an insertion guide base 240. Referring to FIG. 18, reference numeral 241 represents a terminal-cutting lower blade.

FIG. 4 shows a state in which each operation element of the unit 100 is at the point of origin. In the foregoing state, only the holding pin 151 moved downwards has been inserted and allowed to penetrate the circular hole h of the hoop T. Moreover, the feeding pin 146, the locating pin 197, the terminal-cutting upper blade 191 and the hoop-cutting upper blade 196 have been withdrawn to a position upper than the hoop T. At this time, the cam follower 131*f* of the end 131 is in contact with the end of the partial circle 115 of the cam surface 114 of the hoop feeding/holding cam 110, namely, the start end of the partial curve 111. In the hoop locating/cutting cam 120, the end 161 (the cam follower 161*f* ) engaged to the cam groove 121 of the link 160 is positioned at an intermediate position of the partial curve 125 of the cam groove 121.

When the plate cams 110 and 120 in the foregoing state have been rotated clockwise in FIG. 4, the end 131 of the hoop-feeding link 130 traces the partial curve 111 of the hoop feeding/holding cam 110. When the end 131 counter-clockwise traces the partial curve 111, the distance from the partial curve 111 to the rotation center 102 (the cam shaft) of the hoop feeding/holding cam 110 is gradually shortened. Therefore, the hoop-feeding link 130 is deviated counter-clockwise. Hence it follows that the cam follower 132*f* at the leading end of the inverted L-shape bottom side of the hoop-feeding link 130 downwards pushes the feeding-pin holder 144 engaged to the cam groove 145. Thus, the feeding pin 146 at an end of the lower projection of the feeding-pin holder 144 is moved downwards. Simultaneously, the inverted L-shape bottom side of the hoop-feeding link 130 presses the cam follower 150*f* formed in the bent portion of the lever 150. Thus, the lever 150 is caused to perform the seesaw operation, causing the end of the L-shape lower side to upwards be moved. As a result, the holding pin 151 present in the foregoing position is moved upwards. The holding pin 151 is completely removed from insertion of the hoop after the feeding pin 146 has been inserted into the corresponding insertion hole. Removal timing must be designed by combining parameters including the shape (the length of the arm and the position of the rotation center) of the L-shape lever 150, the position of contact with the hoop-feeding link 130, the lengths of the feeding pin 146 and the holding pin 151, the shape of the cam surface of the hoop feeding/holding cam 110 and the amplitude of swings of the hoop-feeding link 130.

The end 161 (the cam follower 161*f*) of the link 160 of the hoop locating/cutting cam 120 traces the partial curve 125 from the intermediate point of the partial curve 125 to the boundary with the adjacent partial curve 126. Since the distance from the partial curve 125 to the rotation center (the cam shaft 102) of the hoop locating/cutting cam 120 is not changed, the link 160 is not moved during tracing of the partial curve 125. The angle from the intermediate position of the partial curve 125 to the boundary with the partial curve 126 is 25°. Also the partial curve 111 of the hoop feeding/holding cam 110 makes an angle of 25°. Therefore, the end 131 of the hoop-feeding link 130 at the point of origin tracing the partial curve 111 reaches the boundary with the central partial curve 112 simultaneously with a moment of time at which the end 161 of the link 160 tracing the partial curve 125 reaches the boundary with the partial curve 126.

Figure 12:
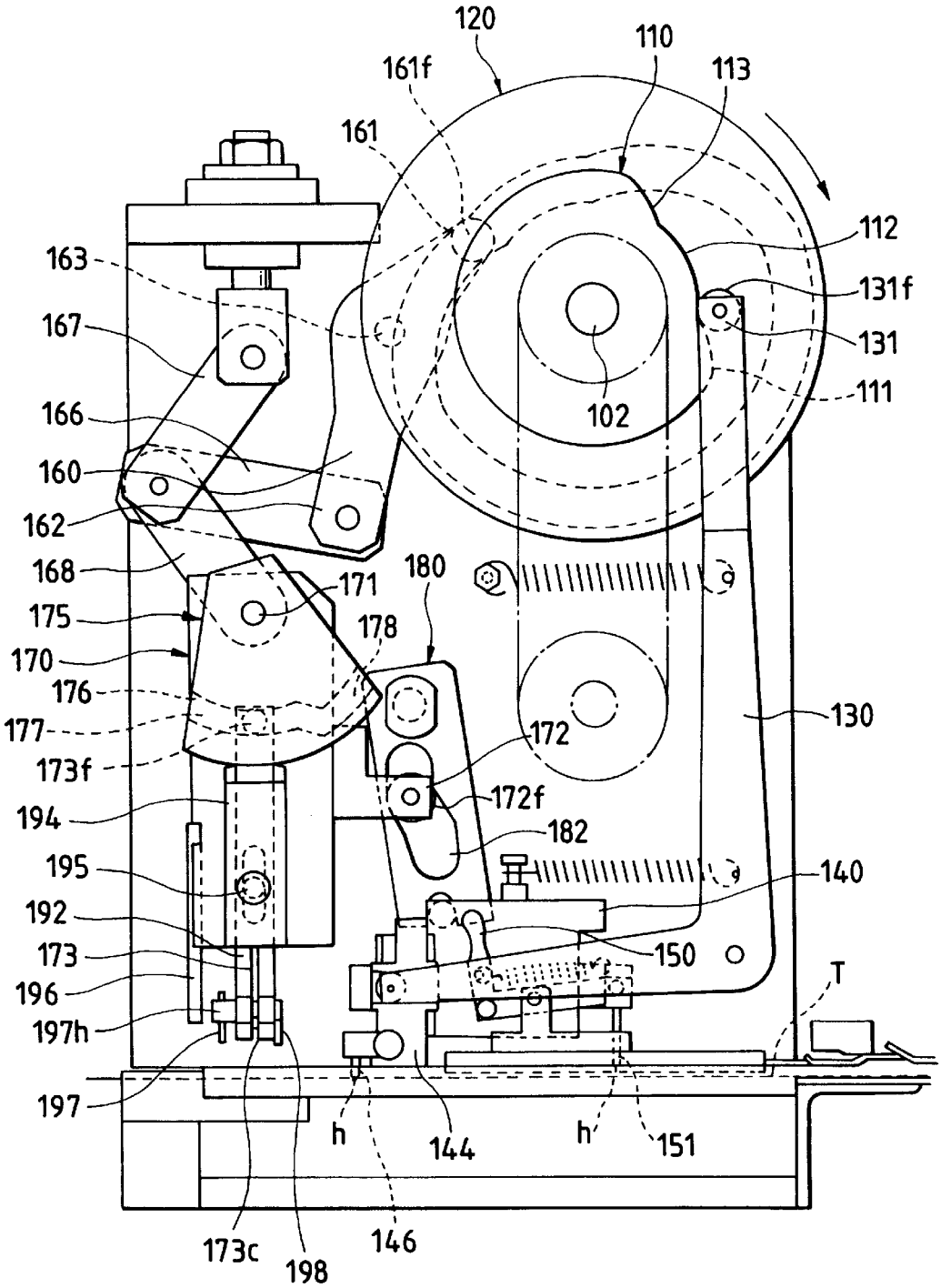
FIG. 12 is a rear view showing a flow of the operations for holding, feeding, locating and cutting the hoop performed by the terminal mounting machine.

FIG. 12 shows a state where the end 131 of the hoop-feeding link 130, which has traced the partial curve 111, has reached the boundary with the central partial curve 112. Moreover, the leading end of the link 160, which has traced the partial curve 125, has reached the boundary with the partial curve 116. In a period in which the foregoing state is realized from the point of origin shown in FIG. 4, the hoop-feeding link 130 is continuously deviated counter-clockwise as described above. Thus, the feeding pin 146 at the end of the lower projection of the feeding-pin holder 144 is inserted into the circular hole h of the hoop T. Thus, the holding pin 151 is moved upwards to permit complete removal from the circular hole h of the hoop T.

Since the link 160 is not rotated, the stationary states of the cutting mechanism (the linking mechanisms 166, 167 and 168 and the cutting ram 170) connected to the other end 162 are maintained. Therefore, also the cam follower 172*f* at the right-hand projection 172 of the cutting ram 170 does not trace the cam groove 182 of the cam arm 180. Hence it follows that also the feeding plate 140 for moving the feeding pin 146 into the hoop feeding direction (the horizontal direction) is not moved.

Figure 13:
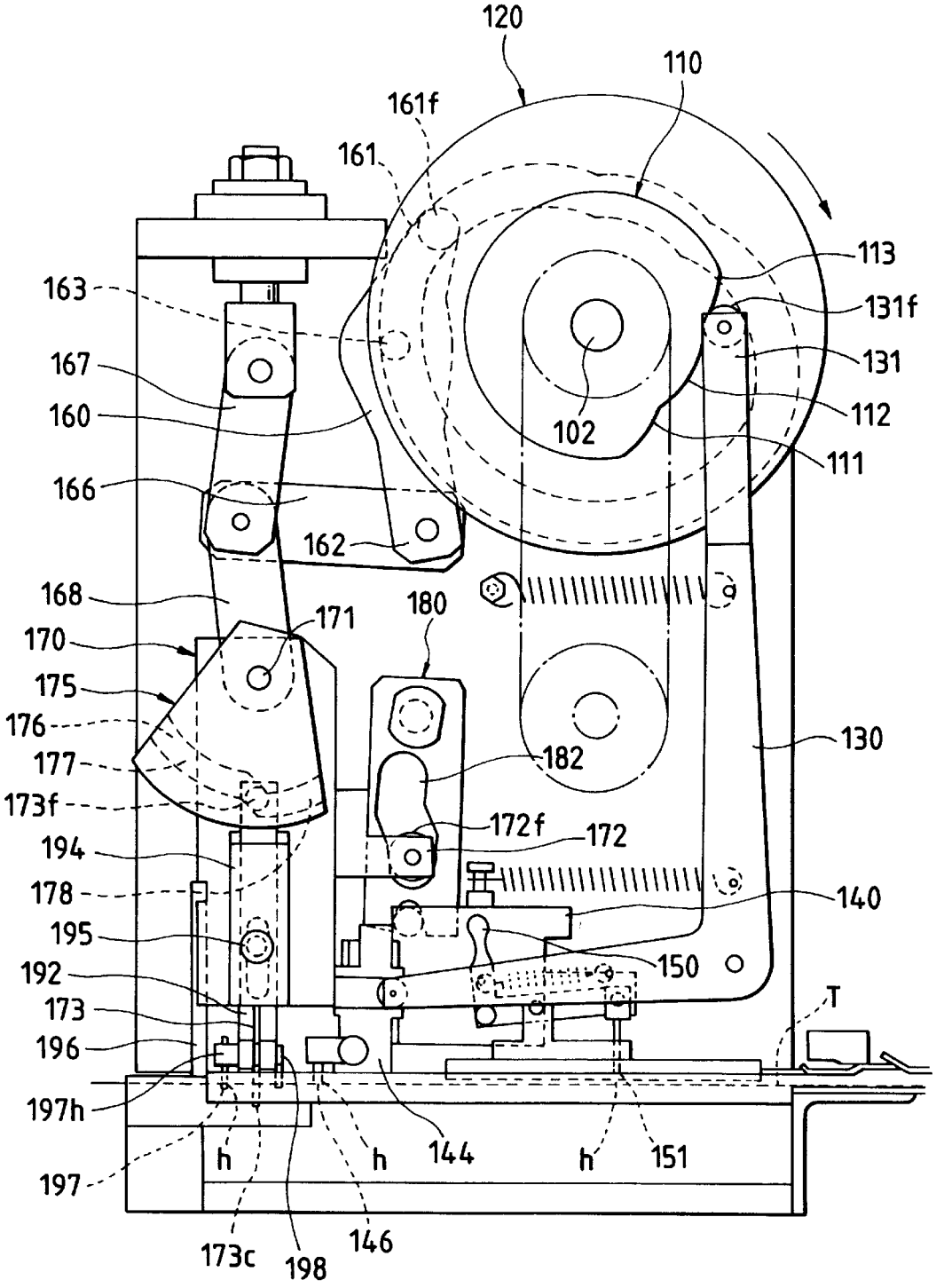
FIG. 13 is a rear view showing a next process of FIG. 12.

Then, the cam shaft 102 in the state shown in FIG. 12 is furthermore rotated clockwise by 55° so that the distance from the partial curve 112 to the rotation center is, as shown in FIGS. 5 and 13, always constant in a period in which the cam follower 131*f* of the hoop feeding/holding cam 110 at the upper end 131 of the hoop-feeding link 130 traces the partial curve 112 to reach the boundary with the partial curve 113. Therefore, the hoop-feeding link 130 in the state shown in FIG. 12 is not moved. That is, the state where the feeding pin 146 which has been inserted into the circular hole h of the hoop T and the holding pin 151 which has been moved upwards is maintained.

As shown in FIGS. 6 and 13, the cam follower 161*f* of the link 160 traces the partial curve 126 in the cam groove 121 of the hoop locating/cutting cam 120 toward the boundary with the partial circle 122. The distance from the partial curve 126 to the center (the axial center of the cam shaft 102) is gradually elongated when the cam follower 161*f* traces the partial curve 126. Therefore, the link 160 rotates counterclockwise, causing the link 166 having the end joined to the other end 162 of the link 160 to be pulled to the right in the drawing. Hence it follows that the links 167 and 168 having the ends connected to the other end of the link 166 are aligned straight. Therefore, the other end of the link 168 is moved downwards, causing the cutting ram 170 connected to the connecting shaft 171 of the link 168 to be pushed downwards.

After the cutting ram 170 has downwards been moved, the operation of the hoop-cutting upper blade 196 disposed at the lower end of the cutting ram 170 to cut the hoop T and the operation of the terminal-cutting upper blade 191 to separate the terminal t are started. Prior to the start of the foregoing operations, the cam follower 172*f* of the projection 172 formed in the right portion of the cutting ram 170 is moved from the upper straight portion of the cam groove 182 of the cam arm 180 to be allowed to pass through the intermediate inclined portion so as to be moved to the lower straight portion. Therefore, the cam arm 180 is rotated clockwise in the drawing so that the cam follower 140*f* of the feeding plate 140 engaged to the lower end groove 183 to be pushed to the left in the drawing is pushed to the left in the drawing. Thus, the feeding pin 146 disposed at the lower end of the feeding-pin holder 144 is pushed to the left, causing the hoop T to be fed in the feeding direction (to the left in the drawing).

When the cutting ram 170 is moved downwards, the rotations of the link 168 cause the fixed shaft 171 at the lower end of the link 168 to be rotated counterclockwise around the axis thereof. Since the plate cam 175 for the terminal introducing guide is secured to the connecting shaft 171, also the plate cam 175 is simultaneously rotated counterclockwise in the drawing. The cam follower 173*f* of the upper end 173*a* of the introducing guide is engaged to the cam groove 176 of the plate cam 175. When the plate cam 175 is rotated, the cam follower 173*f* is relatively moved along the cam groove 176 of the plate cam 175. In the foregoing process, the cam follower 173*f* traces the partial curve 177, the distance of which from the rotation center (the axial center of the fixed shaft 171) is constant. Therefore, the terminal introducing guide 173 does not slide with respect to the cutting ram 170 during the fore going process. The terminal introducing guide 173 is moved downwards for a distance corresponding to the downward movement of the cutting ram 170.

In the foregoing process, the movement of the feeding plate 140 causes the predetermined cutting position for the hoop T and the separating position for the terminal t by cutting to be immediately above the hoop-cutting upper blade 196 and the terminal-cutting upper blade 191. At timing of the foregoing operation, insertion of the locating pin 197 joined to the cutting ram 170, the operation of the terminal locator 192 to restrain the terminal in the widthwise direction and the operation of the hoop guide 198 to press the hoop are first performed. Immediately after the foregoing operations, the operation of the hoop-cutting upper blade 196 to cut the hoop T and that of the terminal-cutting upper blade 191 (as for the corresponding lower blade 241, see FIG. 18) to separate the terminal t by cutting are performed.

Then, the cam shaft 102 is furthermore rotated by 15° (rotated by 95° from the point of origin). The link 160 is furthermore rotated counterclockwise until the end 161 (the cam follower 161*f*) of the link 160 reaches the boundary between the partial curve 126 and the partial circle 122. Thus, the links 167 and 168 are moved to furthermore approximate one straight line, causing the cutting ram 170 to furthermore be moved downwards. Simultaneously with this, the link 168 is furthermore rotated, also the plate cam 175 is furthermore rotated clockwise. Thus, the cam follower 173f engaged to the cam groove 176 of the plate cam 175 is moved from the groove of the central partial curve 177 to the groove in the outer partial curve 178. In the process in which the cam follower 173*f* is shifted between the foregoing grooves, the terminal introducing guide 173 is slid downwards with respect to the cutting ram 170. Thus, the terminal t separated from the hoop T by cutting is downwards introduced into the position of the bottom surface of the cavity s, that is, the upper surface of the insertion guide base 240 by a terminal-introducing plate 173*c* of the terminal introducing guide 173, as shown in FIG. 18. After the terminal t has downwards been introduced into the surface of the insertion guide base 240, the terminal t is inserted into the cavity s of the connector C by a pusher 233 of the terminal inserting mechanism to be described later.

In the hoop feeding/holding cam 110, the end 131 (the cam follower 131*f*) of the hoop-feeding link 130 is shifted to the partial curve 113 to trace the cam surface by 15°, as shown in FIG. 5. Since the distance from the partial curve 113 to the center (the axial center of the cam shaft 102) is gradually elongated when the end 131 counterclockwise traces the partial curve 113, the hoop-feeding link 130 is rotated clockwise. Thus, the feeding pin 146 of the other end 132 is moved upwards so that the feeding pin 146 is removed from the circular hole h. Moreover, the L-shape lever 150 is suspended from the pressure of the hoop-feeding link 130 so that the L-shape lever 150 is rotated clockwise. It leads to a fact that the holding pin 151 at the right-hand end is moved downwards so as to be inserted into the circular hole h. At this time, insertion of the holding pin 151 into the circular hole h is performed at timing before the feeding pin 146 is removed from the circular hole h of the hoop T.

Figure 14:
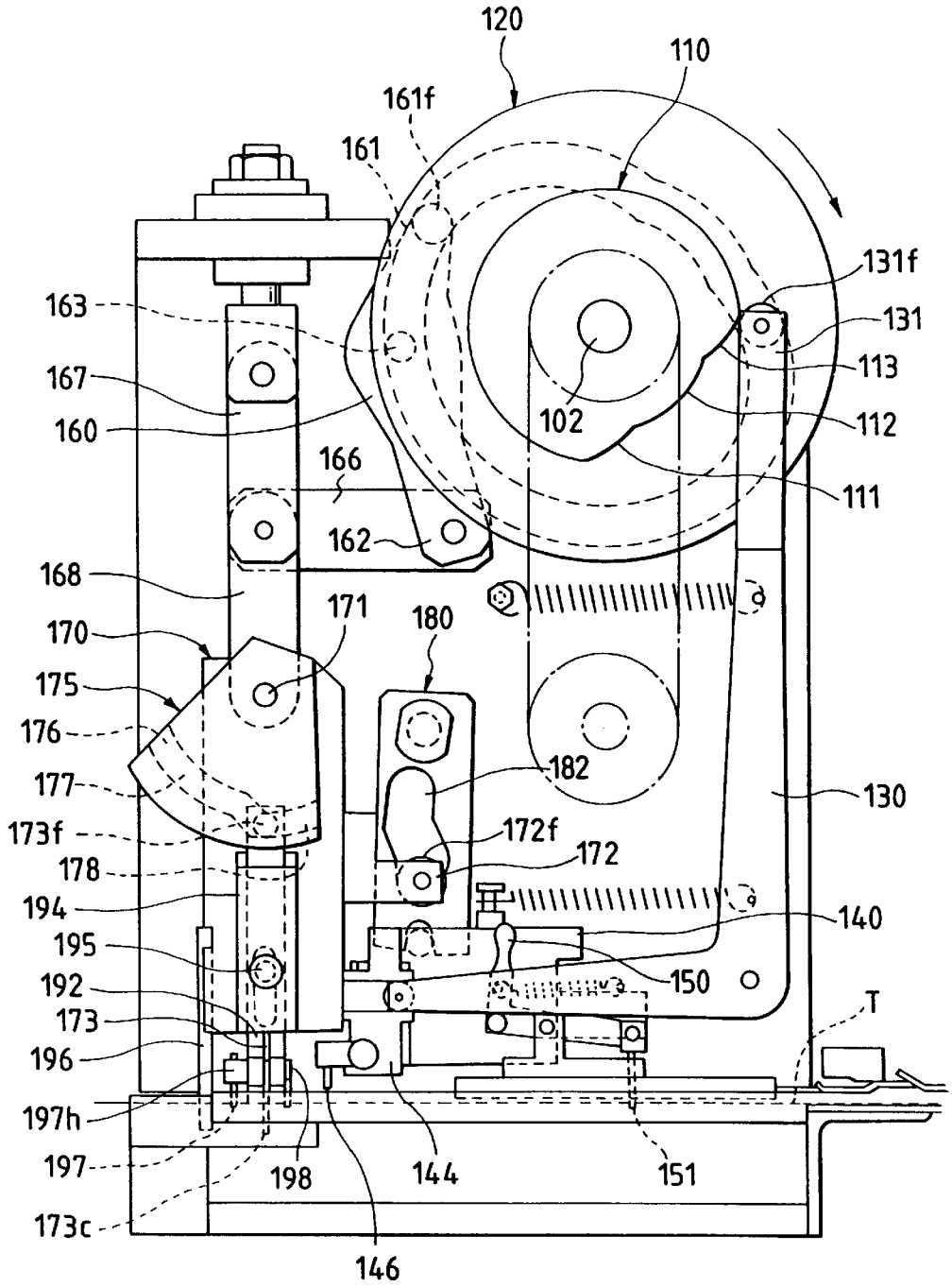
FIG. 14 is a rear view showing a next process of FIG. 13.

As shown in FIG. 5, the position of the contact portion 131 (the cam follower 131*f*) of the hoop-feeding link 130 on the partial curve 113 is maintained until a state shown in FIG. 14 is realized in which the cam shaft 102 is furthermore rotated by 10° to reach the boundary with the partial circle 115. Therefore, the clockwise rotation of the hoop-feeding link 130 is continued, causing the feeding pin 146 of the other end 132 to furthermore be moved upwards. Finally, the feeding pin 146 is completely removed from the insertion hole h. Simultaneously, the L-shape lever 150 is furthermore rotated clockwise, causing the hoop holding pin 151 at the right-hand end to furthermore be moved downwards. Thus, the hoop holding pin 151 is completely inserted and allowed to pass through the insertion hole h.

In the hoop locating/cutting cam 120, the operation of the engaging portion 161 (the cam follower 161*f* ) of the link 160 to trace the groove of the partial circle 122 has been started. In the foregoing tracing process, the link 160 is not rotated. Therefore, the cutting mechanism is not operated. The foregoing state is continued until the operation of the engagement end 161 of the link 160 to trace the partial circle 122 is completed. During the foregoing process, insertion of the terminal t to be described later is performed.

In the following process shown in FIG. 14 to FIG. 15, the operation of the cam follower 131*f* at the upper end of the feeding link to trace the partial circle 115 of the cam surface 114 is continued. Therefore, the operation not the hoop-feeding link 130 is completely inhibited. Also the cam follower 161*f* of the link 160 moves along only the partial circle 122 of the cam groove 121. In the foregoing process, the operations for holding, feeding, performing alignment of the position and cutting the hoop T are not performed. Also in the foregoing period, the operation for inserting the terminal t into the cavity s to be described later is performed.

Figure 15:
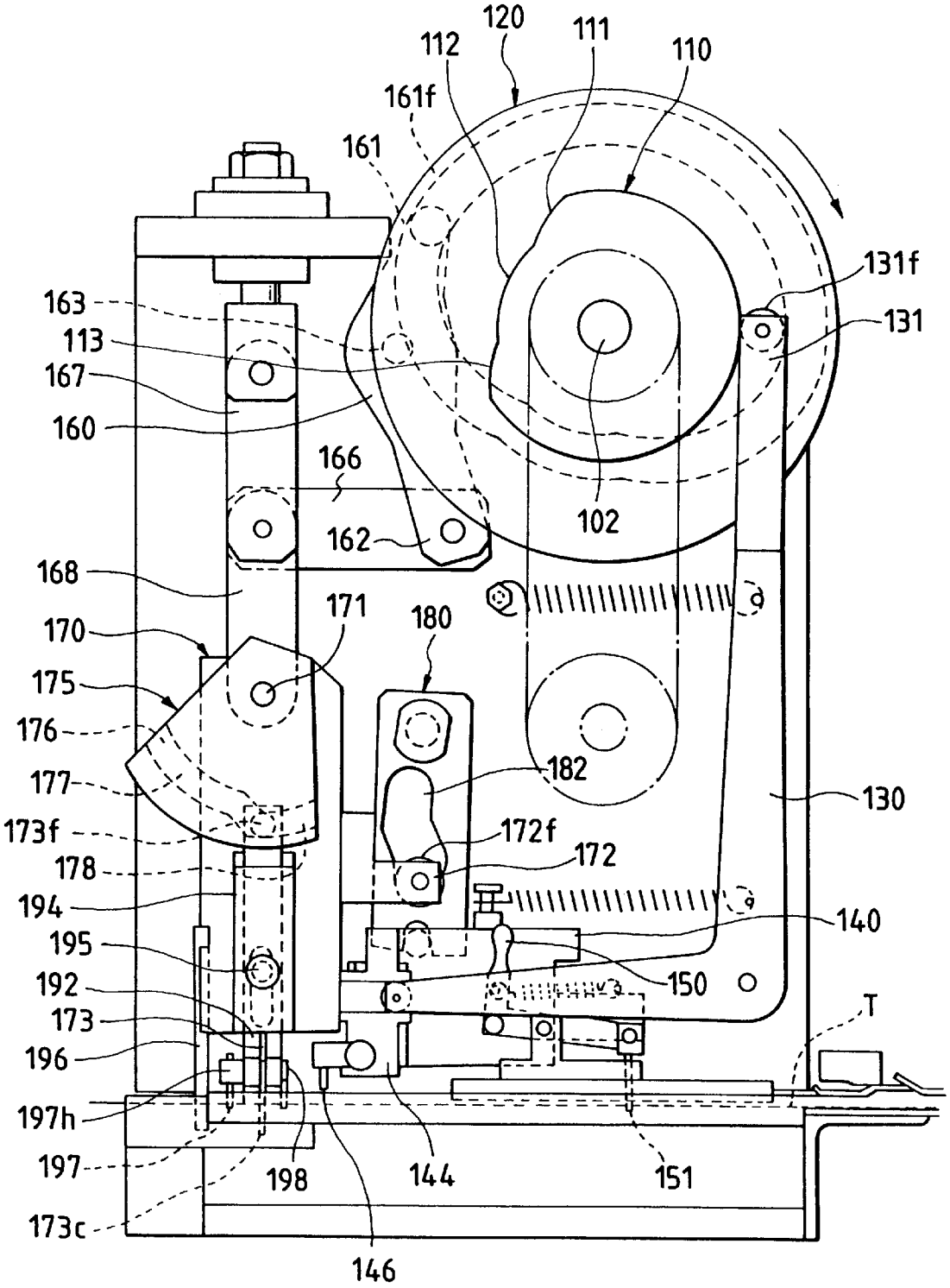
FIG. 15 is a rear view showing a next process of FIG. 14.
Figure 16:
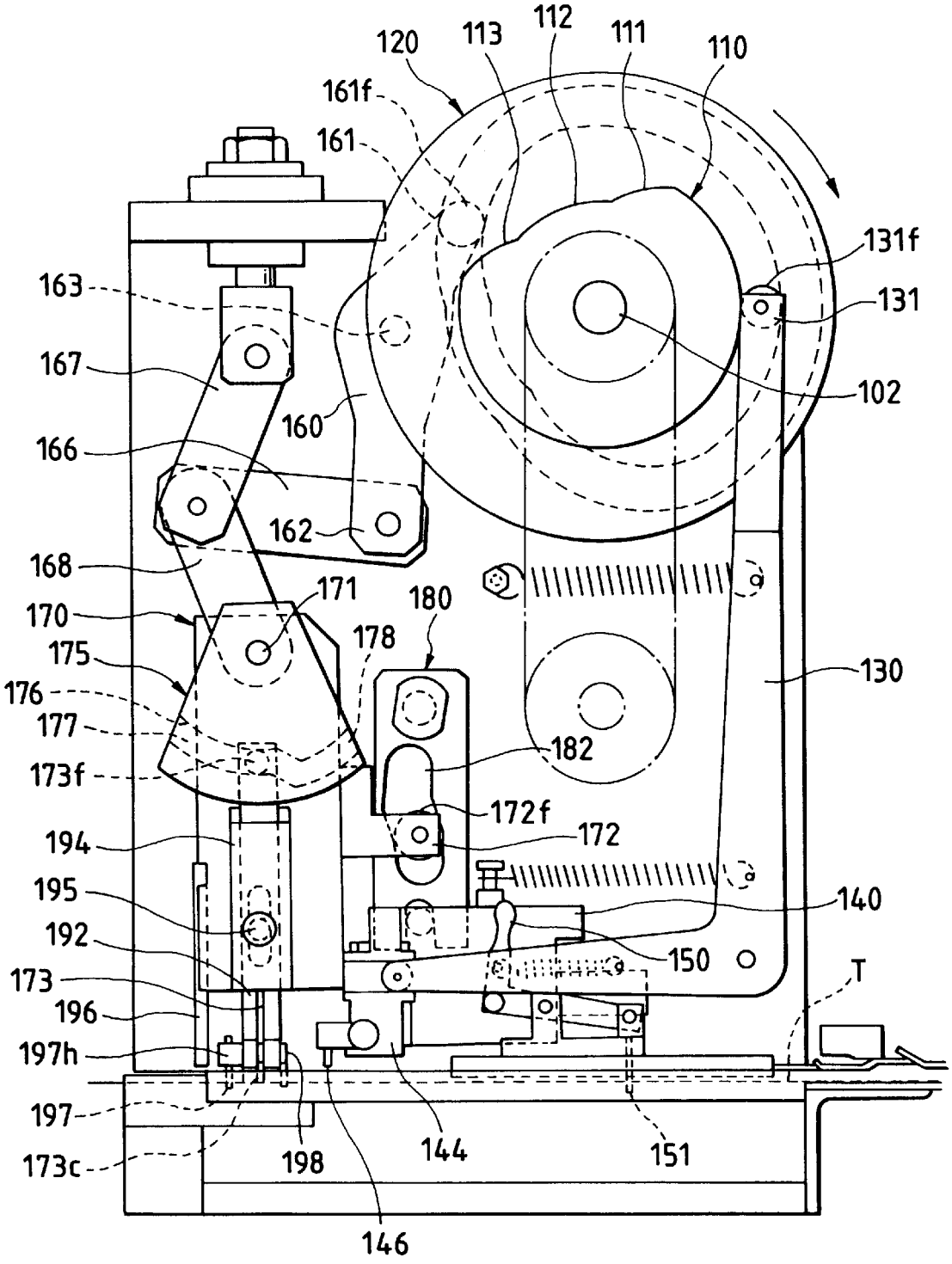
FIG. 16 is a rear view showing a next process of FIG. 15.

In the process shown in FIGS. 15 to 16, the operation of the cam follower 131*f* of the upper end 131 of the feeding link to trace the partial circle 115 of the cam surface 114 is continued. Thus, the cam follower 131*f* is not moved. The cam follower 161*f* of the link 160 is shifted from the partial circle 122 of the cam groove 121 to the partial curve 124. Since the distance from the partial curve 124 to the center is gradually shortened when the cam follower 161*f* counterclockwise traces the partial curve 124, the link 160 is rotated clockwise in the drawing. Thus, the link 166 presses the portion to the left in the drawing, the portion being a portion in which the links 167 and 168 are connected to each other. Thus, the two links 167 and 168 positioned in the straight form are caused to make an angle. As a result, the cutting ram 170 is upwards pulled. Also the connecting shaft 171 at the lower end of the link 168 is rotated counterclockwise. Also the plate cam 175 for the introducing guide engaged to the cam groove 176 is rotated counterclockwise. Therefore, the cam follower 173*f* of the upper end 173*a* of the introducing guide is shifted from the outer groove 178 to the central groove 177. Thus, the terminal introducing guide 173 upwards slides with respect to the cutting ram 170. Thus, all of the locating pin 197, the terminal-cutting upper blade 191, the terminal locator 192, the pad 193, the hoop-cutting upper blade 196 and the hoop guide 198 are moved upwards.

In the final returning process from a state shown in FIG. 16 to the point of origin state shown in FIG. 4, the operation of the cam follower 131*f* at the upper end 131 of the hoop-feeding link 130 to trace the partial circle 115 of the cam surface 114 is continued. Therefore, the hoop-feeding link 130 is not moved. The state where the feeding pin 146 has been removed from the insertion hole h and the holding pin 151 has been inserted into the insertion hole h is maintained.

The cam follower 161*f* of the link 160 traces the cam groove of the partial curve 124 at first. Then, the cam follower 161*f* is shifted to the cam groove of the partial curve 125. In a period in which the partial curve 124 is traced, the clockwise rotation of the link 160 is continued as described above. Thus, upward movement of the terminal introducing guide 173, the locating pin 197, the terminal-cutting upper blade 191 (the terminal locator 192 and the pad 193), the hoop-cutting upper blade 196 and the hoop guide 198 is continued until the cam follower 161*f* reaches the boundary with the cam groove of the partial curve 125. When the cam follower 161*f* reaches the boundary with the partial curve 125, the foregoing elements reach their upper dead centers. Thus, a state in which all of the elements are withdrawn from the hoop is realized.

When the cam follower 161*f* has shifted to the partial curve 125 of the cam groove, the link 160 in the attitude at the start point (at the boundary with the partial curve 124) of the partial curve 125 is not moved because the distance from the partial curve 125 to the rotation center (the cam shaft 102) is constant. The state where the terminal introducing guide 173, the locating pin 197, the terminal-cutting upper blade 191 (the terminal locator 192 and the pad 193), the hoop-cutting upper blade 196 and the hoop guide 198 which have been moved to the upper dead center and stopped is maintained until the link 160 reaches the point of origin shown in FIG. 4.

The operations for holding, feeding, locating and cutting (separating the terminal t) the hoop T are performed as described above. In this embodiment of the present invention, feeding of the hoop T, cutting of the hoop T and separating of the terminal t by cutting are performed such that the feeding pin 146, the holding pin 151 and the locating pin 197 are reliably downwards inserted and allowed to pass through the hole h to perform the foregoing operations. Therefore, "slip" occurring when the conventional example is employed with which the leading end of the feeding blade pokes the inner wall of the hole h can be prevented. If the speed at which the hoop T is fed is raised, the hoop T can completely be restrained. Hence it follows that accurate locating and accurate feeding (accuracy of the amount of feeding) of the hoop T can be performed. Therefore, the terminal can reliably be separated by cutting such that a predetermined shape of the terminal is realized. As a result, products exhibiting high quality can be manufactured with a satisfactory manufacturing yield. Since the apprehension that "slip" occurs can be eliminated, the speed at which the hoop T is fed can easily be raised. As a result, the manufacturing speed can be raised.

The structure and operation of the mechanism for inserting the terminal t into the cavity s will now be described. The operation for inserting the terminal t is performed owing to the operations of the third plate cam 200 joined to the cam shaft 102 of the two plate cams 110 and 120. The structure will now be described with reference to FIGS. 19, 20, 3, 7 and 9.

Figure 19:
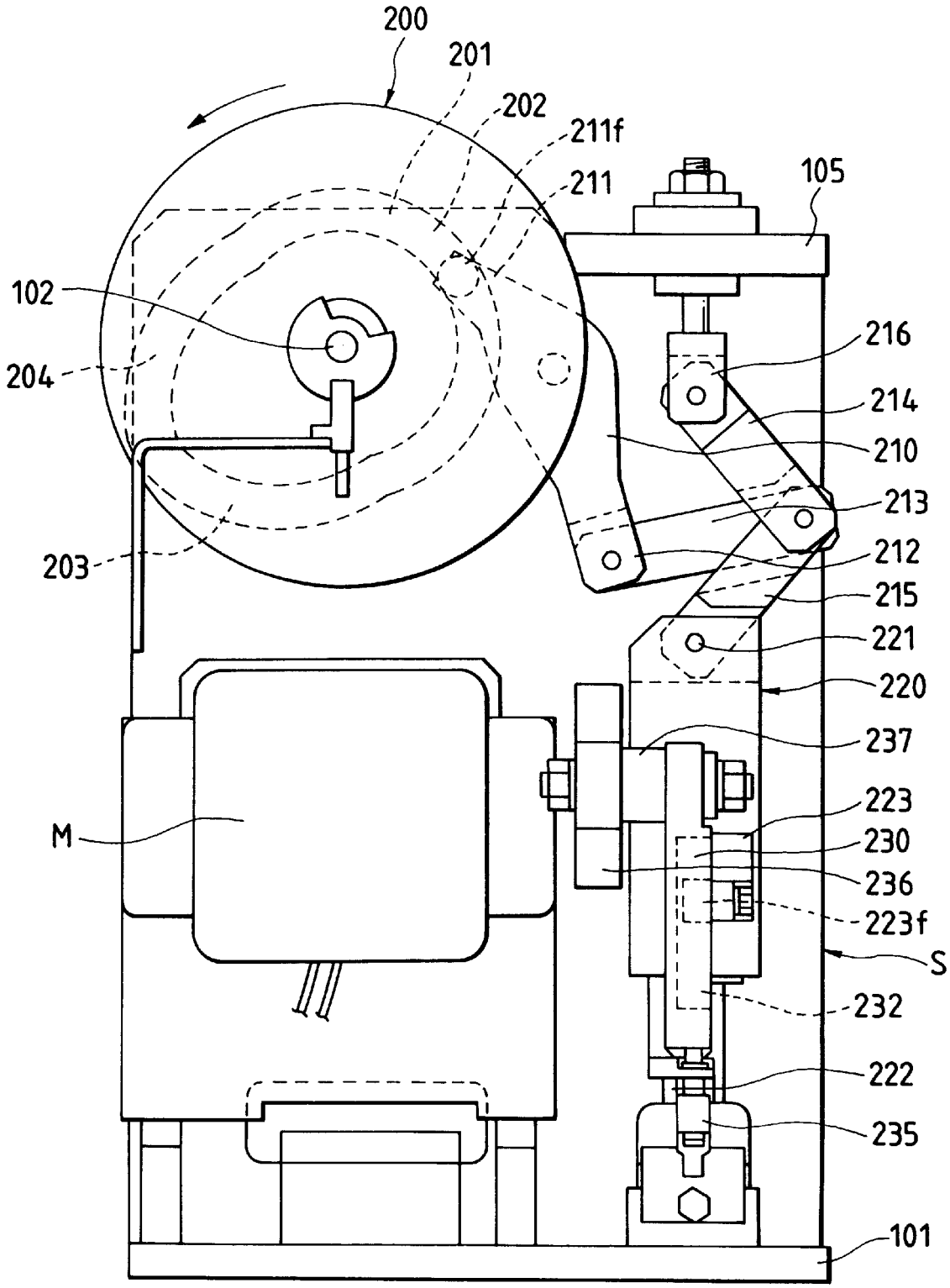
FIG. 19 is a front view showing the terminal mounting machine.
Figure 20:
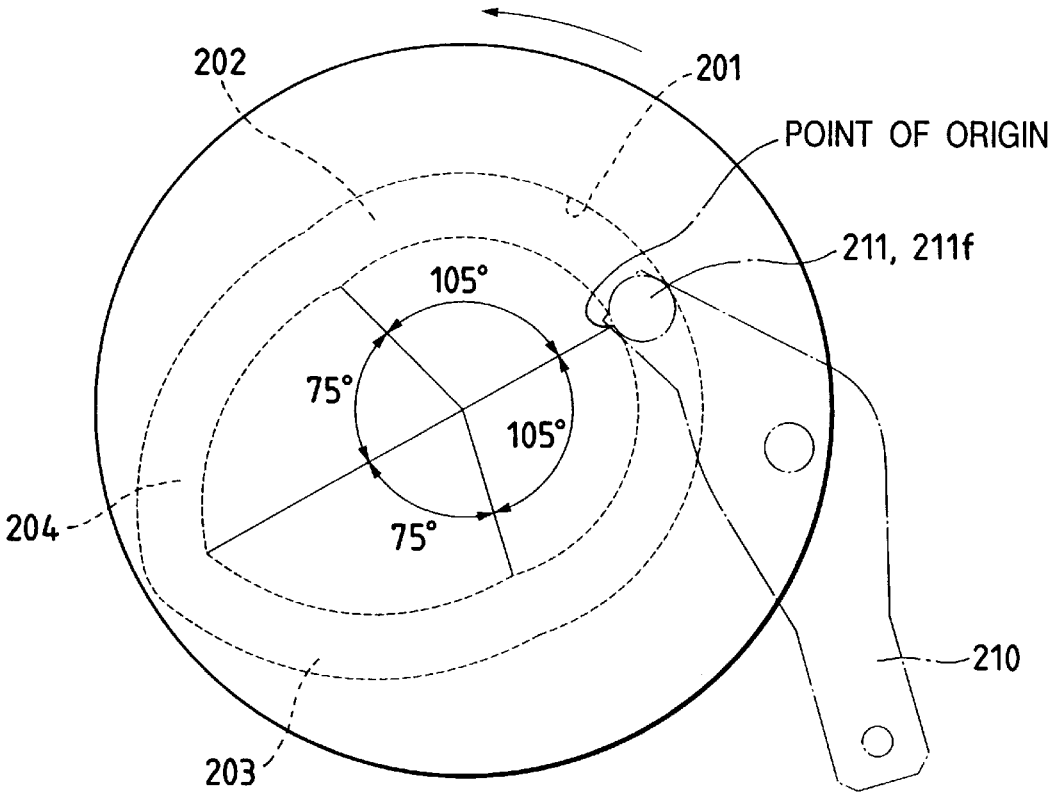
FIG. 20 is a rear view showing a cam for inserting the terminal.

The terminal-inserting plate cam 200 shown in FIGS. 19 and 20 is formed into a disc shape having a rear surface (the rear surface of the line) provided with a cam groove 201 formed as indicated with a dashed line. As shown in FIG. 20, the cam groove 201 is composed of a partial circle 202 making an angle of 210°. The residual portion is formed by connecting two projecting partial curves 203 and 204 facing outside to each other. The two connected partial curves 203 and 204 and the partial circle 202 are connected to one another so that a closed curve passage is formed. The two partial curves 203 and 204 are symmetrical (each corresponding angle is 75°) with respect to a line connecting the boundary point between the partial curves 203 and 204 and the rotation center (the cam shaft 102) of the terminal-inserting plate cam 200. The distance from each of the two curves 203 and 204 to the rotation center of the terminal-inserting plate cam 200 is longer than the radius of the partial circle 202. When the partial curve 203 is clockwise traced, the distance of the partial curve 203 is gradually elongated as compared with the radius of the partial circle 202. The foregoing distance is made to be longest at the boundary with the partial curve 204. On the other hand, the distance of the partial curve 204 is gradually shortened as compared the distance realized at the boundary with the partial curve 203. The foregoing distance is made to be the same as the radius of the partial circle 202 at the boundary with the partial circle 202.

A cam follower 211*f* at an end 211 of the link 210 joined to the horizontal rotational shaft 163 (see FIGS. 3 and 7) which is the same shaft for the link 160 engaged to the cam groove 121 of the second plate cam 120 is engaged to the cam groove 201. An end of a link 213 is rotatively connected to another end 212 of the link 210, ends of two links 214 and 215 are connected to the other end of the link 213. Another end of the link 214 is swingably joined to the lower end of an adjust holder 216 connected to the support plate 105 on the upper surface of the stand S. A terminal-inserting ram 220 is, owing to a pin 221, swingably joined to another end of the other link 215. The rear surface of the terminal-inserting ram 220 is engaged to a linear guide 222 provided for the front surface of the stand S so as to be capable of vertically sliding along the linear guide 222. A support-point block 236 to which a terminal-inserting-pusher holder 230 is joined is provided for the stand S at a position to the left of the terminal-inserting ram 220 in FIG. 19, the support-point block 236 being provided such that its portion for joining the terminal-inserting-pusher holder 230 projects horizontally. The pusher holder 230 has an end 231 which is swingably joined to the leading end of the support-point block 236 with a pin 237. A cam groove 232 is formed in the right-hand surface (the right-hand surface in FIG. 19) facing the line. A cam follower 223*f* at the leading end of a follower supporter 223 provided for the terminal-inserting ram 220 is engaged to the cam groove 232. A pusher 233 for pressing the terminal t is swingably joined to the swingable end of the terminal-inserting-pusher holder 230 through an adjustment block 235.

The pusher 233 is formed into a rod shape disposed in a horizontal guide groove 234 provided for the inside portion of the base plate. The central axis of the pusher 233 is made coincide with the central axis of the terminal separated from the hoop T and placed on the retaining surface. When the terminal t is inserted, the inserting mechanism causes the pusher 233 to be moved in the guide groove 234 to push the rear surface of the terminal t from just behind. The reason why the pusher 233 is swingably joined to the terminal-inserting-pusher holder 230 will now be described. Since the pusher 233 is restrained in the horizontal direction in the guide groove 234, variation in the joining direction caused from the rotation of the terminal-inserting-pusher holder 230 must be absorbed.

The cam and link mechanism for inserting the terminal is structured as described above. The operation of the mechanism will now be described. FIGS. 21 to 24 sequentially show the flow of the insertion operation. In each of FIGS. 21 to 24, A is a front view, and B is a right-hand view such that cross sections of the pusher 233 and its guide groove 234 are included.

Figure 21B:
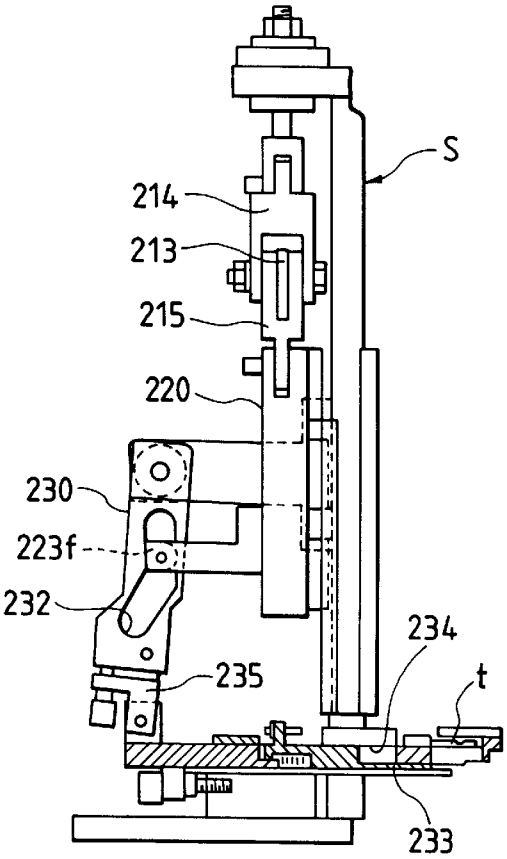
FIG. 21B is a right-hand side view of FIG. 21A.
Figure 21A:
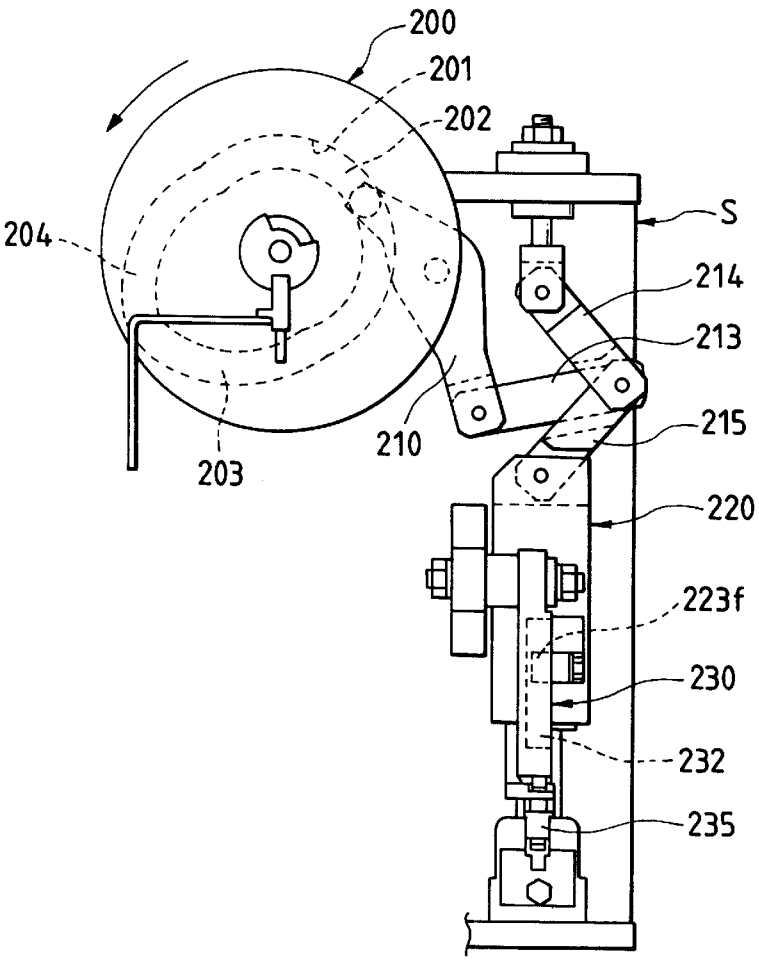
FIG. 21A is a front view showing a flow of an operation of the terminal mounting machine to insert the terminal.

FIG. 21 shows a state of the point of origin of the terminal inserting mechanism. At this time, the hoop feeding/holding mechanism and the locating/cutting mechanism (hereinafter simply called as a hoop feeding mechanism are at the point of origin shown in FIG. 4.

The end 211 (the cam follower 211*f*) of the link 210 is at the intermediate position of the partial circle 202 of the cam groove 201. The leading end of the pusher 233 for inserting the terminal t is withdrawn to a position at which interference with the locating pin 197, the terminal-cutting upper blade 191 and the hoop-cutting upper blade 196 which are moved downwards can be prevented when the lower end of the terminal-inserting-pusher holder 230 having the end at which the pusher 233 is swingably held is at the leftmost position in the drawing. The terminal-inserting plate cam 200 in the foregoing point of origin state is rotated counterclockwise in the drawing so that the operation of the terminal inserting mechanism is started.

FIG. 22 shows a state where the end 211 engaged to the cam groove 201 traced the partial circle 202 has reached the boundary with the partial curve 203. In a period in which the state shown in FIG. 21 reaches the foregoing state, the link 210 does not swing. Thus, the state where the operation for inserting the terminal t is inhibited is maintained. When the state shown in FIG. 22 has been realized, the terminal-inserting plate cam 200 has been rotated by 105. The foregoing state is an intermediate state of the terminal hoop feeding mechanism in a period of shift from the state shown in FIG. 13 to the state shown in FIG. 14.

In the cam 110, the end 131 (the cam follower 131*f*) of the hoop-feeding link 130 has traced the partial curve 113 by 20° and the holding pin 151 moved downwards is being inserted into the circular hole h of the hoop T. During the insertion of the holding pin 151 into the circular hole h, the operation for removing the feeding pin 146 from the circular hole h is performed.

In the cam 120, the end 161 (the cam follower 161*f*) of the link 160 has traced the partial curves 125 and 126 and traced the partial circle 122 by 10°. A state at the foregoing moment of time is a state in which the cutting ram 170 has downwards been moved and also the terminal introducing guide 173 has downwards been moved with respect to the cutting ram 170 so that the terminal t has been separated from the hoop T by cutting and downwards introduced into the position of the bottom surface of the cavity s of the connector C.

When the hoop feeding mechanism has reached a state shown in FIG. 14, the holding pin 151 and the feeding pin 146 are moved to the lower dead center and the upper dead center, respectively. Also the locating pin 197 is moved to its lower dead center. Then, the state shown in FIG. 14 is changed to a state shown in FIG. 16 through a state shown in FIG. 15. In the foregoing period, the hoop-feeding link 130 and the link 160 are not moved. Thus, the operations for holding, feeding, locating the cutting the hoop T are not performed. The terminal inserting mechanism is operated in a process of transition from the state shown in FIG. 22 to the state shown in FIG. 23. Thus, insertion of the terminal t is performed.

Figure 22B:
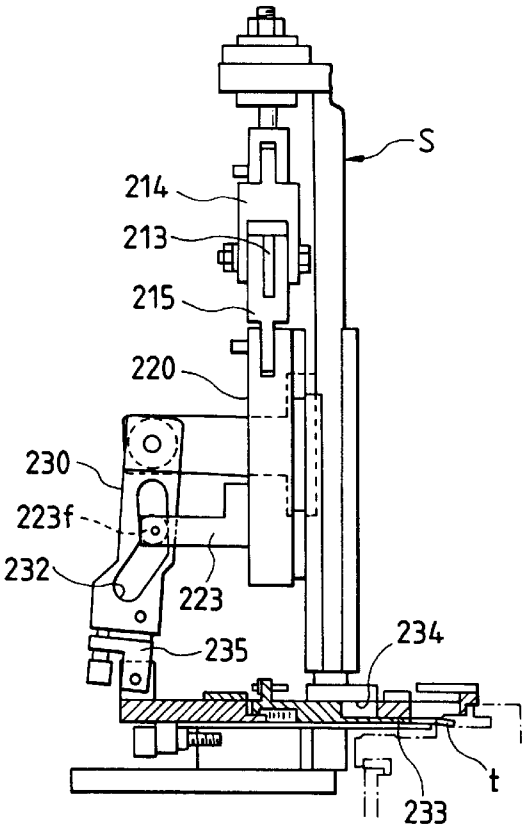
FIG. 22B is a right-hand side view of FIG. 22A.
Figure 22A:
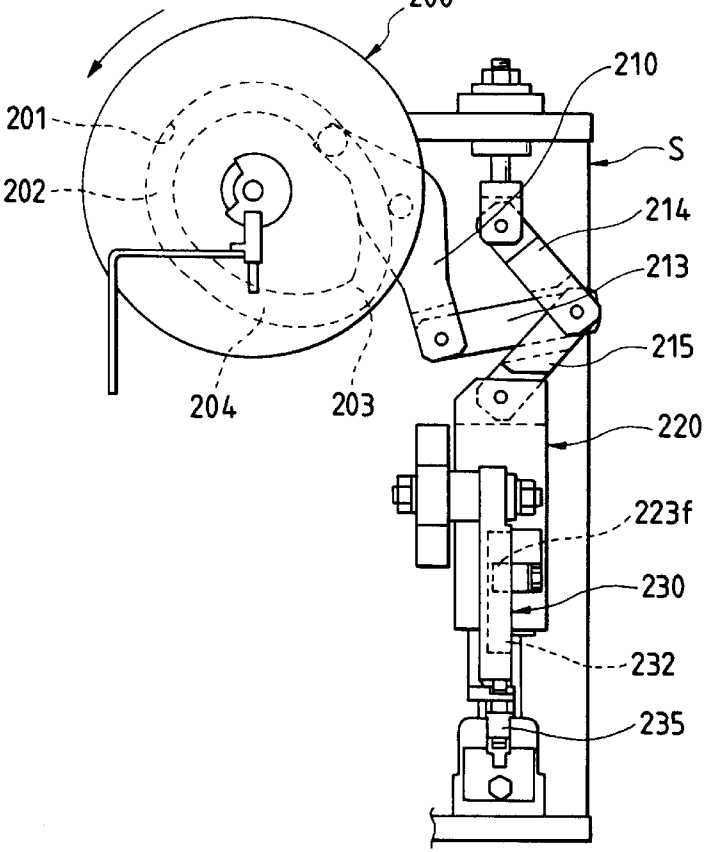
FIG. 22A is a front view showing a next process of FIG. 21.

When the cam 200 in the state shown in FIG. 22 has been rotated counterclockwise in the drawing, the end 211 (the cam follower 211*f*) of the link 210 is shifted from the partial circle 202 of the cam groove 201 to the partial curve 203 of the same. The distance from the partial curve 203 to the rotational shaft 102 of the cam 200 is longer than the radius of the partial circle 202. Moreover, the foregoing distance is gradually elongated as the cam 200 rotates counterclockwise in the drawing. Therefore, the link 210 is rotated clockwise in FIG. 22. Since the link 210 is rotated clockwise, the link 213 joined to the other end 212 pulls the connection portion between the links 214 and 215 to the left in FIG. 22A. The included angle between the two links 214 and 215 is gradually enlarged. Thus, the lower link 215 downwards slides the terminal-inserting ram 220 joined to the lower end of the link 215.

Figure 38:
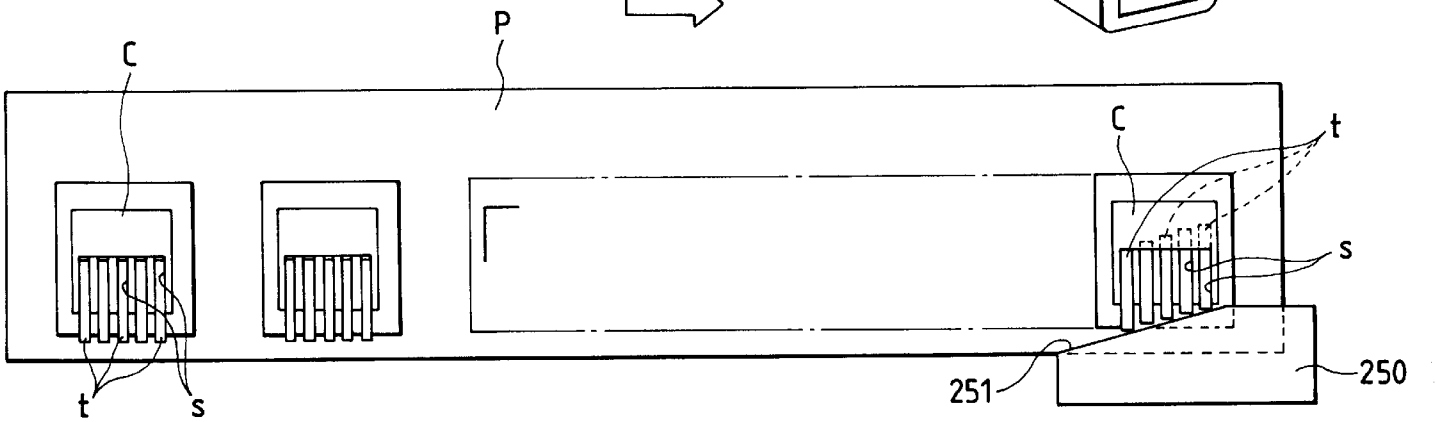
FIG. 38 is a schematic plan view showing a problem experienced with the conventional technique.

When the terminal-inserting ram 220 has been slid downwards, the cam follower 223*f* at the leading end of the follower supporter 223 secured to the terminal-inserting ram 220 downwards traces the cam groove 232 of the terminal-inserting-pusher holder 230. Thus, the terminal-inserting-pusher holder 230 is rotated counterclockwise in FIG. 22B. Hence it follows that the pusher 233 swingably joined to the lower end of the terminal-inserting-pusher holder 230 through the adjustment block 235 is moved to the right in FIG. 22B. Thus, the leading end of the pusher 233 pushes the rear surface of the terminal from just behind so that the terminal t is inserted into the cavity s. In this embodiment, the terminal t is inserted into the cavity s as described above. Therefore, deformation and breakage of the terminal t experienced with the conventional method shown in FIG. 38 can be prevented. Moreover, insufficient degree of insertion can be prevented.

A state shown in FIG. 23 in which the end 211 (the cam follower 211*f*) of the link 210 traced the partial curve 203 has been moved to the boundary with the partial curve 204 will now be described. The foregoing state is a state in which the end 211 of the link 210 is at the farthermost position from the center 102 of the plate cam 200, the deviation of the terminal-inserting-pusher holder 230 is made to be greatest and the pusher 233 has been inserted the terminal t most deeply.

Figure 23B:
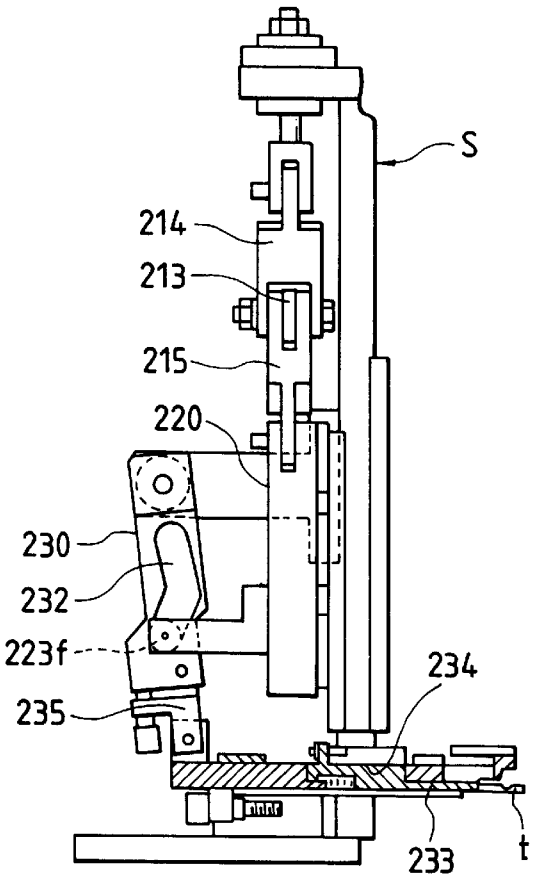
FIG. 23B is a right-hand side view showing FIG. 23A.
Figure 23A:
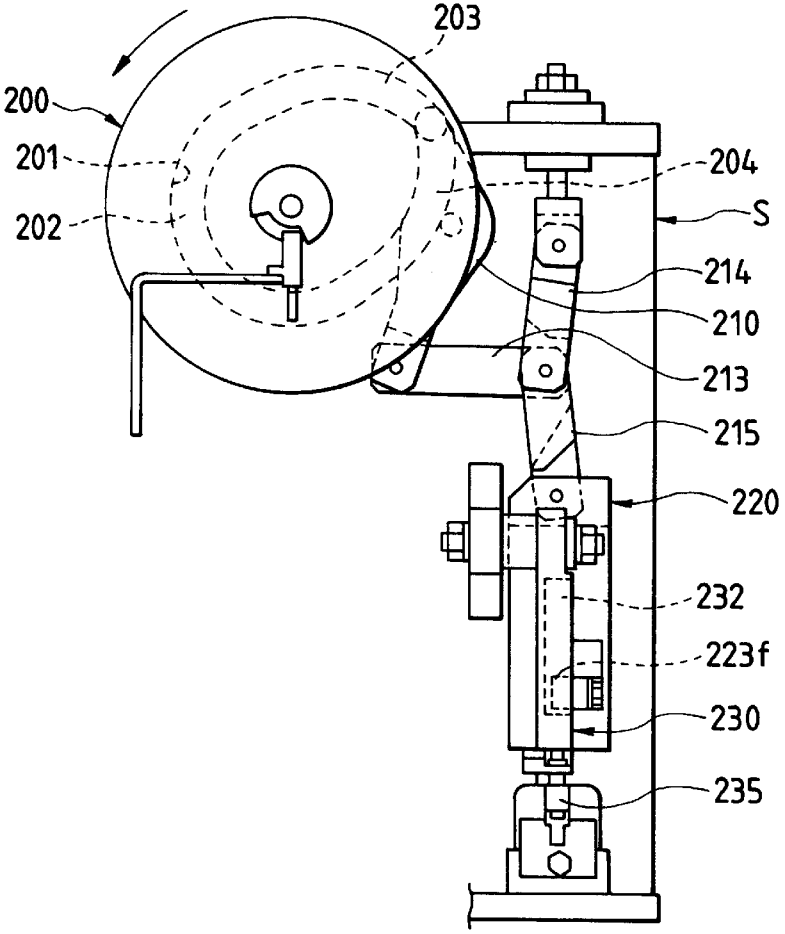
FIG. 23A is a front view showing a next process of FIG. 22.
Figure 24B:
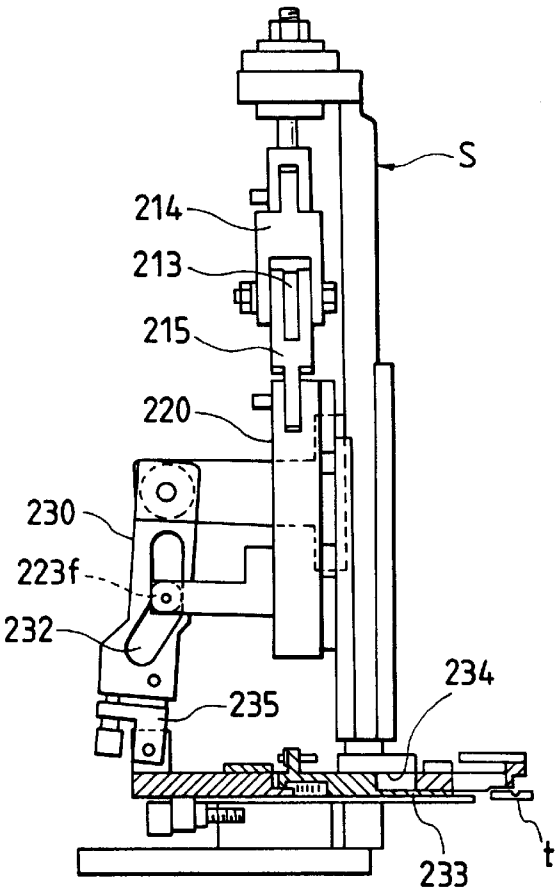
FIG. 24B is a right-hand side view of FIG. 24A.
Figure 24A:
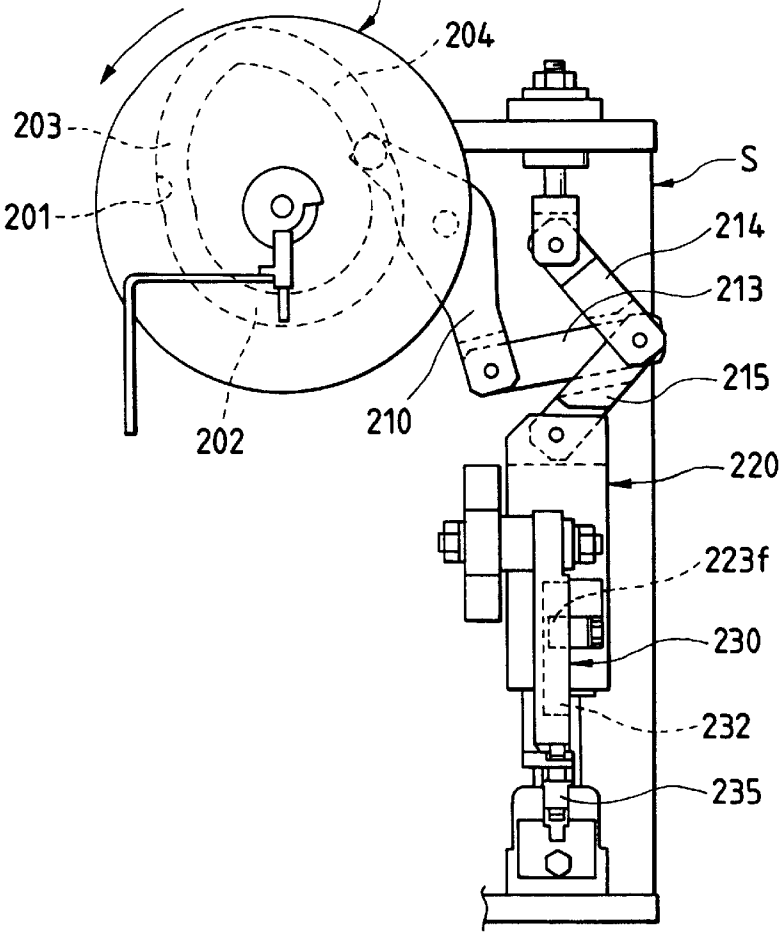
FIG. 24A is a front view showing a next process of FIG. 23.

After insertion of the terminal t has been completed, the mechanism is shifted from the state shown in FIG. 23 to a state shown in FIG. 24. In this process, the end 211 (the cam follower 211*f*) of the link 210 is shifted from the partial curve 203 to the partial curve 204 to trace the partial curve 204. Also the distance from the partial curve 204 to the rotation center 102 of the terminal-inserting plate cam 200 is longer than the radius of the partial circle 202. Clockwise tracing of the partial curve 204 means a fact that the end 211 of the link 210 gradually approach the central 102 of the terminal-inserting plate cam 200. Therefore, the link 210 is rotated counterclockwise in FIG. 23. The counterclockwise rotation of the link 210 causes the link 213 joined to the other end 212 of the link 210 to push the connection portion between the links 214 and 215 to the right in the drawing. The included angle between the links 214 and 215 shown in FIG. 24B is gradually reduced through the straight state. Thus, the lower link 215 upwards slides the terminal-inserting ram 220 joined to the lower end of the link 215.

When the terminal-inserting ram 220 has been slid upwards, the cam follower 223*f* at the leading end of the follower supporter 223 secured to the terminal-inserting ram 220 upwards traces the cam groove 232 of the terminal-inserting-pusher holder 230. Thus, the pusher holder 230 is rotated clockwise in FIG. 24B. Thus, the adjustment block 235 at the lower end of the terminal-inserting-pusher holder 230 is moved to the left in FIG. 24B so that the pusher 233 is pulled in the left-hand direction. Therefore, the leading end of the pusher 233 is moved away from the rear end of the terminal t. The foregoing final state is shown in FIG. 24. At this time, the end 211 which is engaged to the cam groove 201 of the link 210 is positioned at the trailing end of the partial curve 204, that is, the start end of the partial circle 202.

The end 211 which is engaged to the cam groove 201 of the link 210 traces the partial circle 202 of the cam groove 201 until return to the point of origin shown in FIG. 21 is performed. Therefore, the end 211 is not moved and also the link 210 is not rotated. The inserting mechanism is operated as described above in the process for inserting the terminal t.

In this embodiment of the present invention, the cam and link mechanism performs the operations for holding, feeding, locating and cutting the hoop T and separating the terminal by cutting and inserting the terminal. The plate cams 110, 120 and 200 are operated by the one cam shaft 102 which is operated by one motor M to operate each mechanism. Therefore, each mechanism does not require a corresponding operation source. As a result, the size of the apparatus and power consumption can be reduced.

As a matter of course, a cylinder mechanism or another known introducing/removing mechanism may be employed to vertically move each elevating pin and cutting blade and insert/remove the insertion pins.

After the terminal t has been mounted on the connector C as described above, the pallet P is moved for a predetermined distance by a conveying mechanism provided for the rails R and incorporating a ball screw (not shown) go as to be shifted to the next wire pressing unit B.

The wire pressing unit B incorporates two pressing machines 20 and 30, a wire measuring/feeding machine 40 provided for the upper upstream pressing machine 20 and a wire carrying/rotating unit 50. The wire measuring/feeding machine 40 incorporates a wire brake unit 41, a wire-feed-length detecting encoder unit 42 and a wire feeding unit 43. Thus, the electric wires a by a required number and in a required color are fed to the upper upstream pressing machine 20 by a required length (as for details of the wire measuring/feeding machine 40, refer to the Unexamined Japanese Patent Application Nos. Hei 10-154423 and Hei 10-212068).

The upstream pressing machine 20 incorporates a ball screw 21*a* having the structure shown in FIGS. 25 to 28 and arranged to be operated by a servo motor 21 to vertically move an arbitrary pressing mold 22 so as to connect the electric wire a to the terminal t in the cavity s. As for the structure and operation of the upstream pressing machine 20, refer to the Unexamined Japanese Patent Application No. Hei 10-106374.

Figure 29:
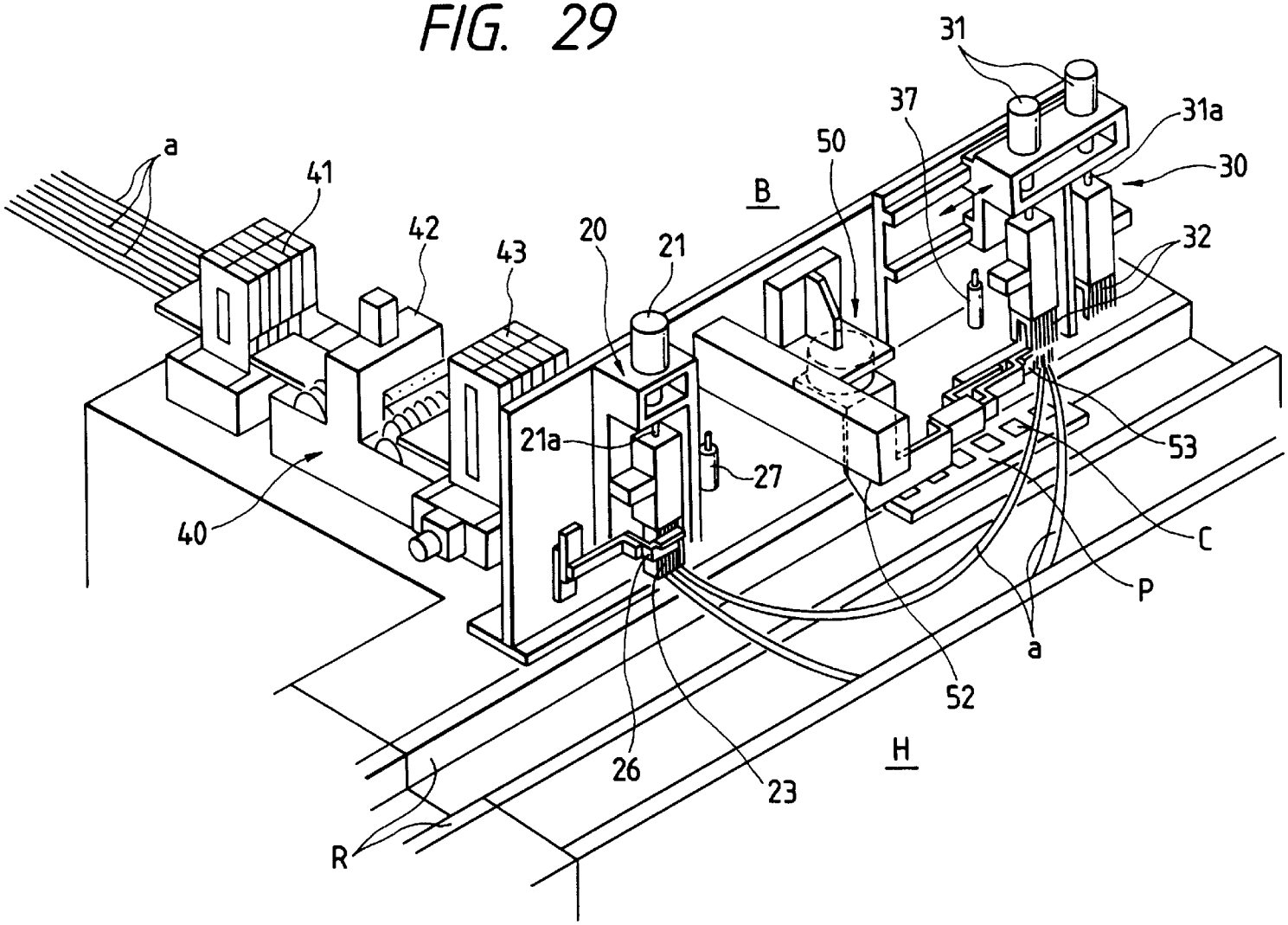
FIG. 29 is a diagram showing an essential portion of the operation of the embodiment.
Figure 30:
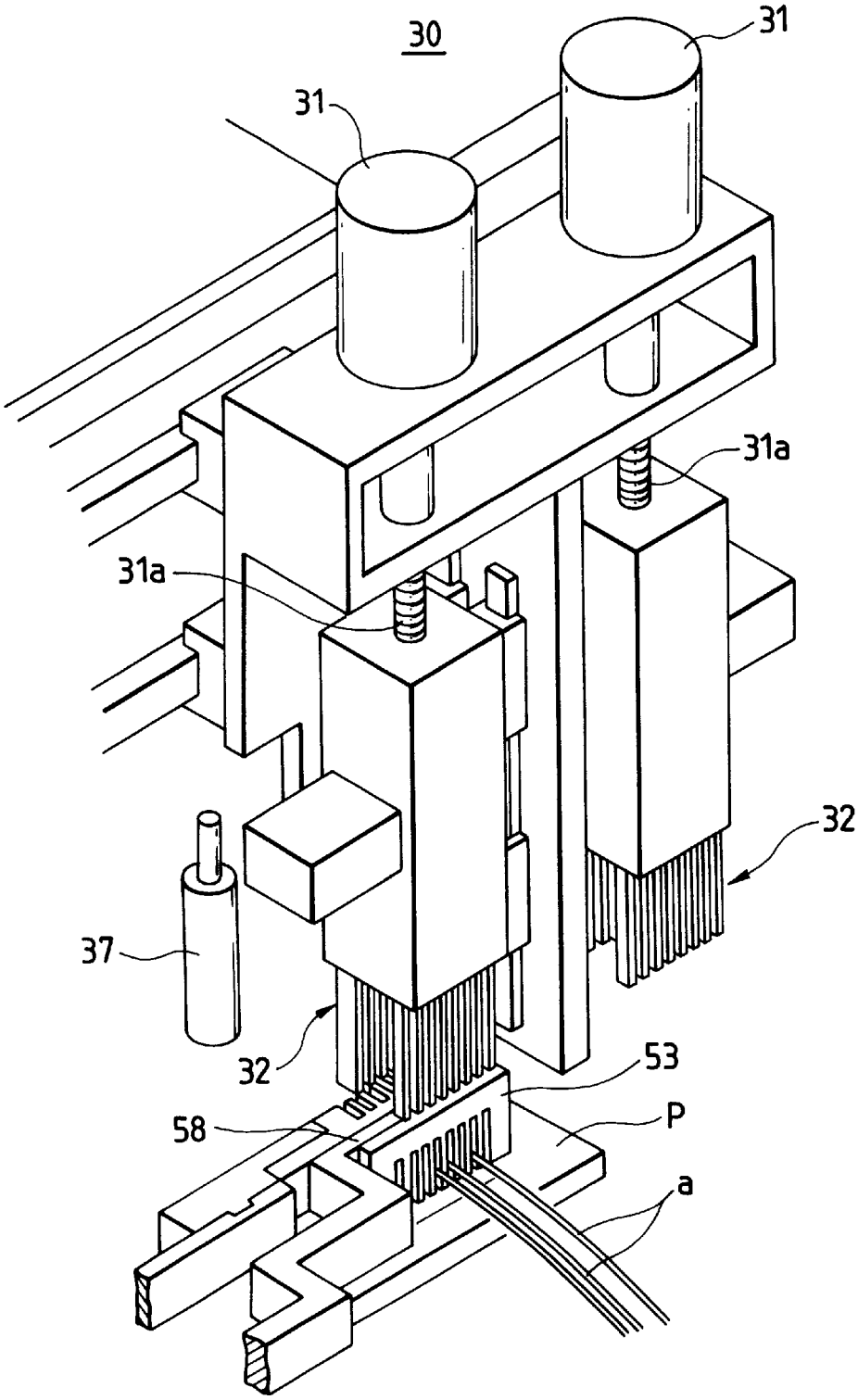
FIG. 30 is a perspective view showing another pressing machine according to the embodiment.
Figure 31:
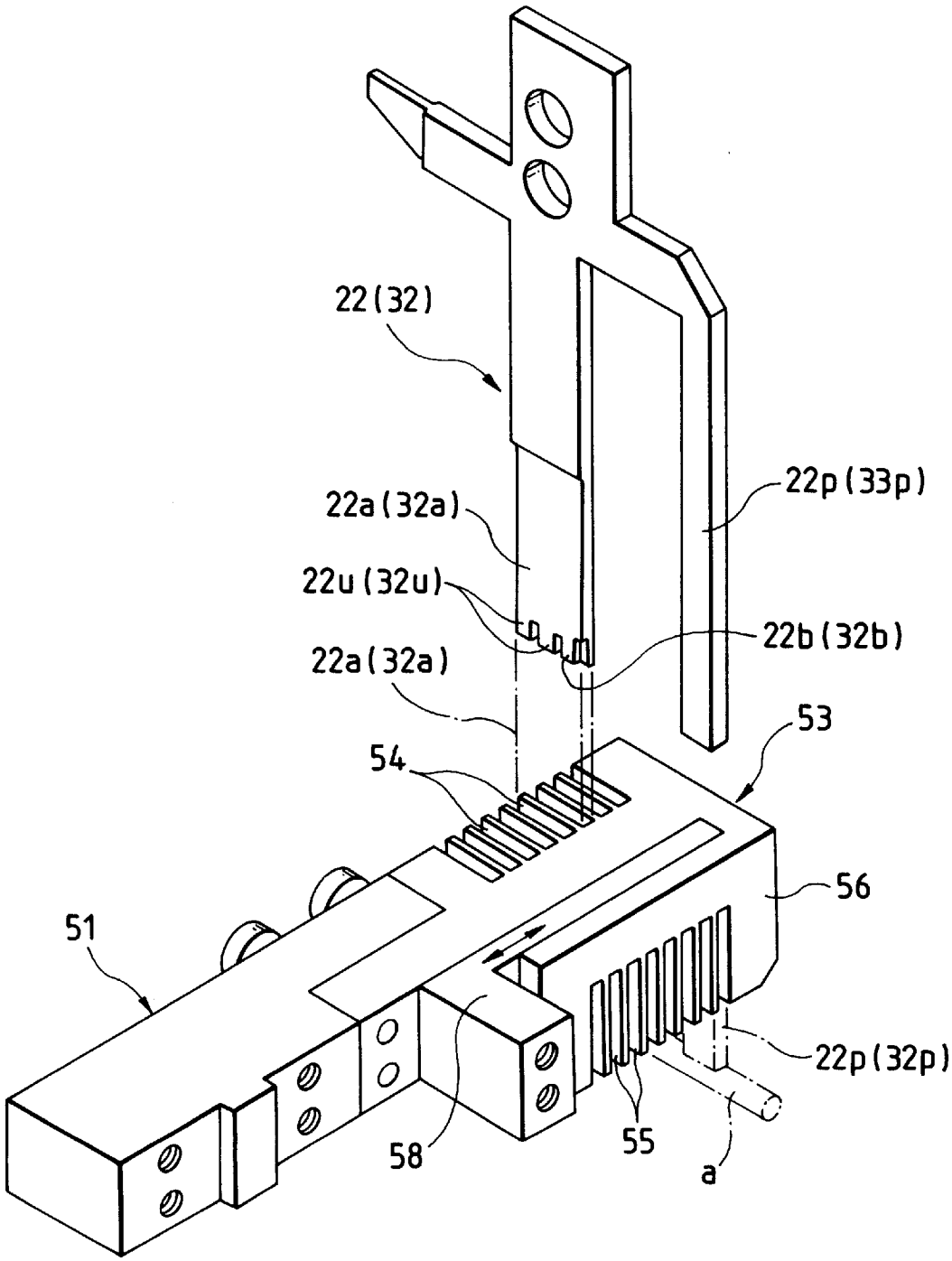
FIG. 31 is a perspective view showing a chucking portion.

A wire guide 23 which is capable of moving vertically is disposed below the plural pressing molds 22. The guide 23 has a slit 24 formed vertically to permit insertion of the pressing mold 22; and a lateral slit 25 formed perpendicular to the slit 24 and opened in the front and rear surfaces. In a state where the wire guide 23 has been moved upwards, a predetermined number of electric wires a are fed from the wire measuring/feeding machine 40. A wire aligning tool 26 which is capable of moving vertically is provided for the front surface of the guide 23. When the wire aligning tool 26 is moved downwards, the electric wires a inserted into the guide 23 are aligned. The wire guide 23 and the wire aligning tool 26 are downwards moved simultaneously (simultaneously with the downward movement of the pressing mold 22). Note that the structure of the guide 23 has substantially the same structure as that of a chucking mechanism 53 to be described later. Refer to FIG. 31 and the Unexamined Japanese Patent Application No. Hei 10-97888, As shown in FIGS. 29 and 30, two downstream pressing machines 30 are provided. The structure and operation of each of the downstream pressing machines 30 is the same as that of the upstream pressing machine 20. That is, a ball screw 31*a* which is operated by a servo motor 31 vertically moves an arbitrary pressing mold 32 (also having the same shape as that of the pressing mold 22 incorporating both of a pressing portion 22*u* (32*u*) and a barrel caulking portion 22*b* (32*b*)). The reason why the two downstream pressing machines 30 are provided lies in that correspondence to different terminal shape and layout of the connector C must be facilitated. The two downstream pressing machines 30 are slid as indicated with an arrow shown in FIG. 29 so as to correspond to the position at which the housing C on the pallet P is pressed. The pressing machines 20 and 30 are provided with pressing bottom-dead-center stroke sensors 27 and 37 to detect a required depth of pressing.

Figure 32A:
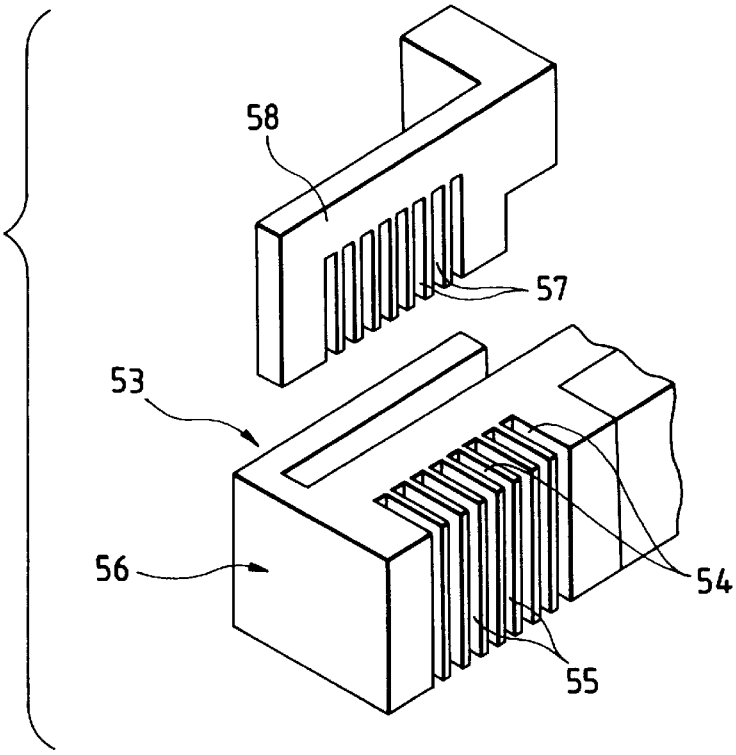
FIG. 32A is an exploded perspective view showing the chuck.
Figure 32B:
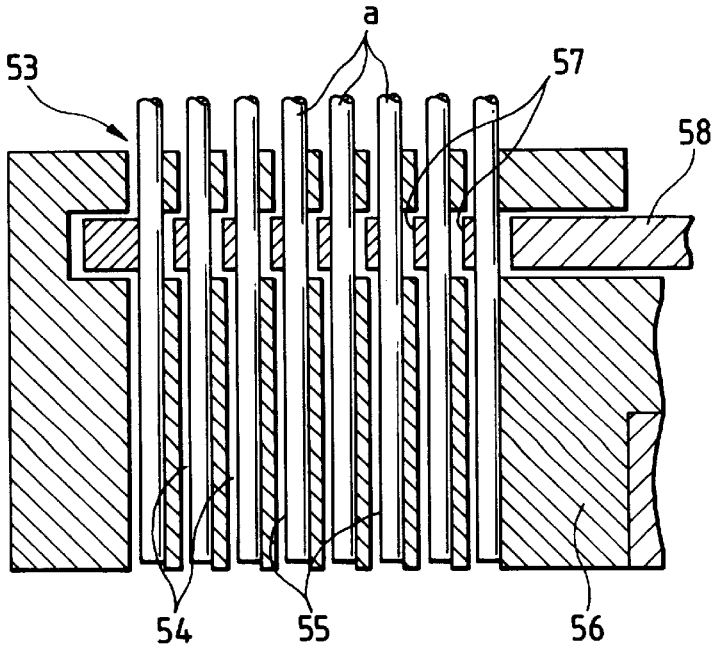
FIG. 32B is a plan cross sectional view showing the wire chucking operation.

The wire carrying/rotating unit 50 incorporates a chuck 53 provided for the leading end of an arm 52 which can reciprocatively be rotated by 180° by a motor 51. As shown in FIGS. 31 and 32, the chucking mechanism 53 incorporates a slit 54 formed vertically; a guide 56 having a slit 55 formed perpendicular to the slit 54 and opened in the front and rear surfaces; and a slide plate 58 engaged to the guide 56 and incorporating a slit 57. The slide plate 58 is moved forwards/rearwards by an air cylinder 59 as indicated with an arrow shown in FIG. 27 to hold and chuck the electric wire a as shown in FIG. 32B in cooperation with the guide 56.

As shown in FIG. 31, the pressing molds 22 and 32 incorporate pressing blades 22*a* and 32*a* for pressing and crimping the electric wire a; and holding blades 22*p* and 32*p* arranged to be brought into contact with the electric wire a projecting over the chuck 53 (the wire guide 23). Therefore, as the connecting (pressing) operation proceeds, the pressing blades 22*a* and 32*a* are inserted into the slits 54 and 24 as indicated with a dashed line. Thus, the electric wire a in the slits 54 and 24 is press-fit against the slot wall u of the terminal t and the barrel portion b of the terminal t is crimped and connected. Simultaneously, also the holding blades 22*p* and 32*p* downwards push the projecting electric wire a to follow the connecting operation. Thus, bending or the like of the electric wire a can be prevented so that a smooth connecting operation is performed.

Figure 25:
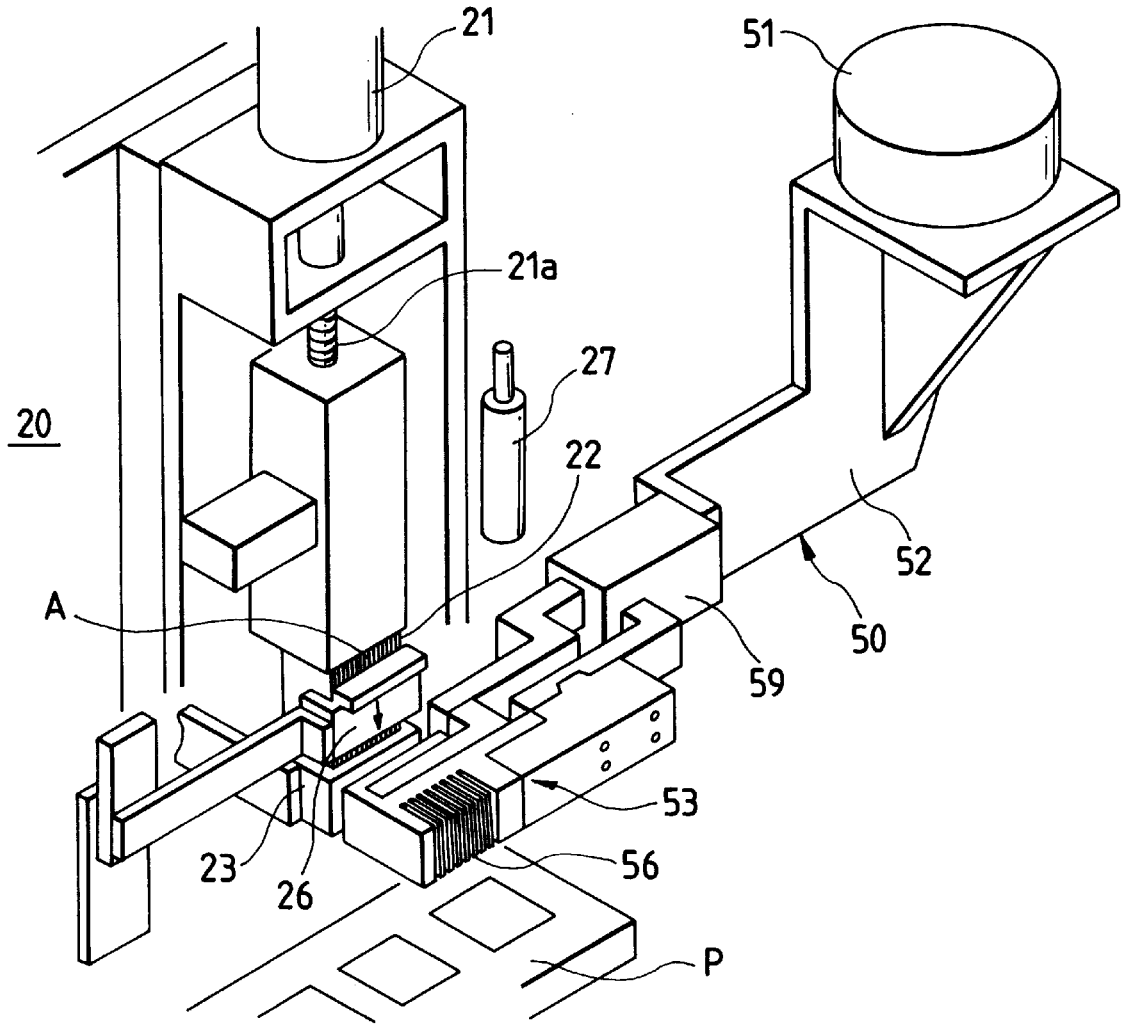
FIG. 25 is a diagram showing an essential portion of the operation of the embodiment.
Figure 26:
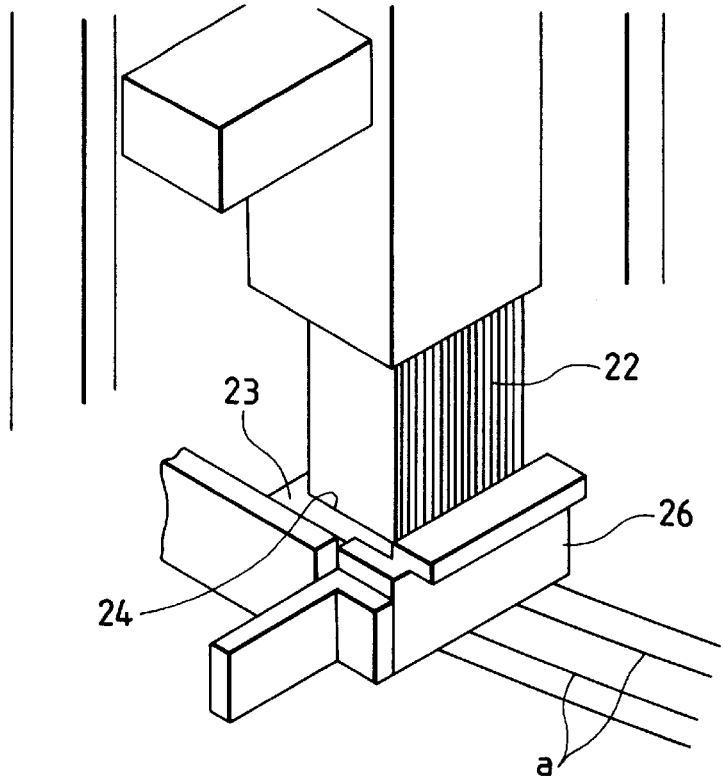
FIG. 26 is a diagram showing an essential portion of the operation of the embodiment.
Figure 28:
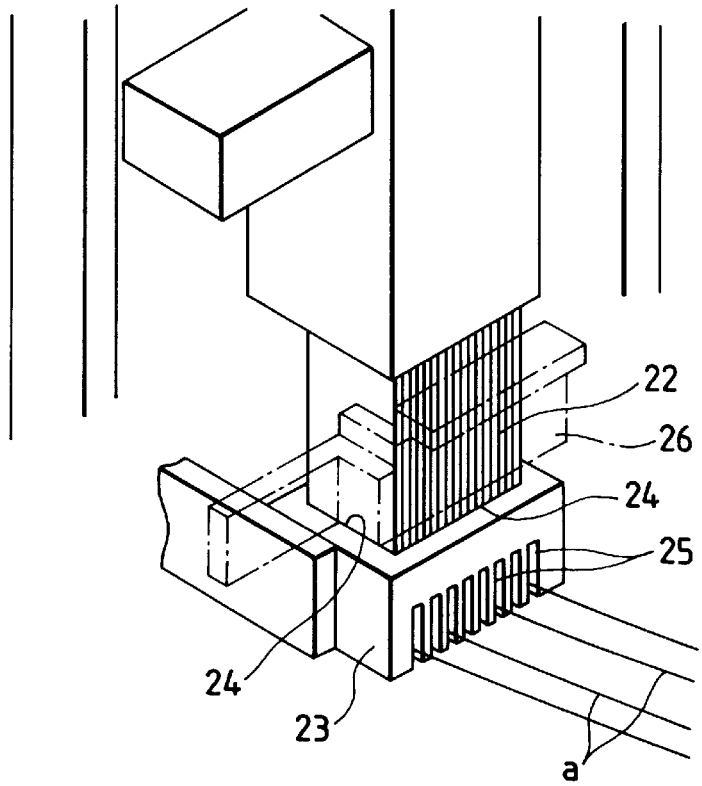
FIG. 28 is a perspective view showing a state where the wire aligning tool shown in FIG. 25 has been removed.

When the pallet P has been moved from the terminal mounting machine A to the wire pressing unit B, the arm 52 is rotated toward the upstream pressing machine 20, as shown in FIG. 25. Thus, the chuck 53 of the arm 52 is disposed along the wire guide 23. In the foregoing state, a required number of required electric wires a are fed from the wire measuring/feeding machine 40 to the wire guide 23 and the chuck 53 (the slits 25 and 55). The amount of feeding is determined in such a manner that a required length of the leading end of the electric wire a is realized when the chuck 53 to be described later has been made to correspond to the other pressing machine 30. The fed electric wires a are aligned by the wire aligning tool 26 (see FIG. 26), and the air cylinder 59 is operated so that the electric wire a is held by the slide plate 58.

Figure 27:
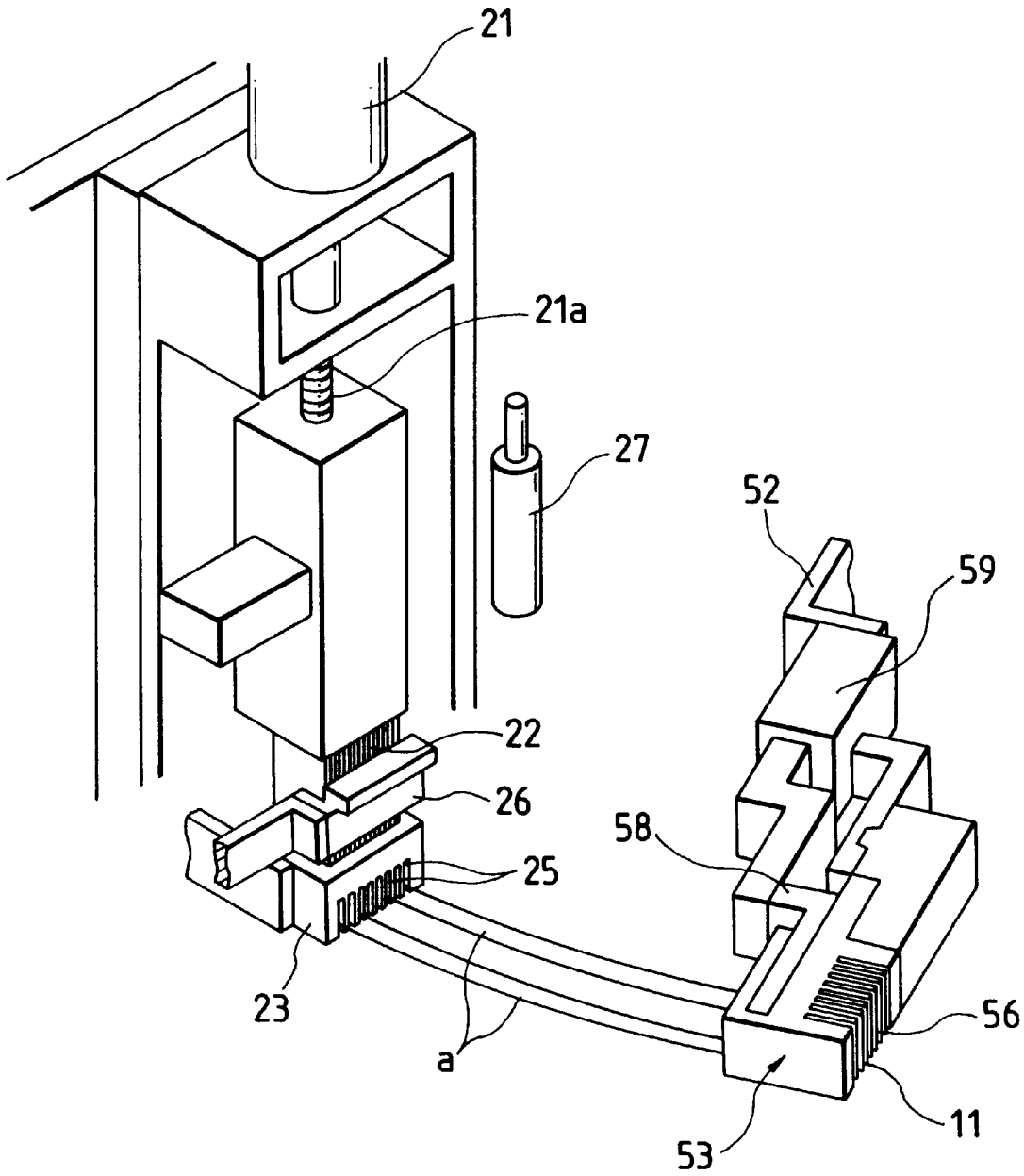
FIG. 27 is a diagram showing an essential portion of the operation of the embodiment.

Thus, the arm 52 is rotated toward the downstream pressing machines 30, as shown in FIG. 27. Also the pallet P is moved toward the downstream pressing machines 30. Note that the pallet P may previously be moved. At this time, the wire measuring/feeding machine 40 measures a required length of each electric wire a to feed the same. When the chuck 53 has been placed along the downstream pressing machines 30 as shown in FIG. 29, the pressing machines 30 is operated. At this time, the pallet P is moved laterally so that either end of the electric wire a is connected to the housing C and a required terminal t. Hereinafter the end of the electric wire a which is connected by the pressing machines 30 is called as an end A. Another end which must be connected is called as an end B (the end B is connected to the terminal t by the upstream pressing machine 20 as described later). When the end A is connected, the sucking force of the air cylinder 59 is controlled to correspond to the number of electric wires which must be chucked. Thus, the connecting operation is always performed with optimum holding force. After ends A of all of the chucked electric wires a have been connected, the pallet P is moved toward the upstream pressing machine 20.

When the pallet P has been made to correspond to the pressing machine 20, the pressing mold 22 is moved downwards together with the wire guide 23. It leads to a fact that the pallet P is moved to the right and left so that the end B of the electric wire a is connected to the required housing C and the terminal t. Simultaneously with the connecting operation, the pressing mold 22 cuts the electric wire a. That is, this embodiment has a structure that the upstream pressing machine 20 also serves as a wire cutting machine. As for the operation of the pressing mold 22 to cut the electric wire a, refer to the Unexamined Japanese Patent Application No. Hei b 10-106374.

After the ends B of all of the electric wires a fed from the guide 23 have been connected, the arm 53 is again rotated toward the upstream pressing machine 20, as shown in FIG. 25. Then, a similar operation is repeated so that the electric wire a is connected to the housing C. The pallet P subjected to the process in which the electric wire is connected to the connector is shifted to the inspection/assembling unit E in the next process. As for the operation for shifting the pallet P with respect to the pressing machines 20 and 30 to connect the electric wire a to form a cross shape or the like, refer to the Unexamined Japanese Patent Application No. Hei 10-241473.

The inspecting and assembling unit E incorporates an appearance inspecting unit 60 disposed in the forward portion thereof to perform an image process of the housing C placed on the pallet P so as to perform an appearance inspection (correctness of the connection) of a state where the electric wire a and the terminal t have been connected to each other. An assembling unit disposed in the rear portion of the inspecting and assembling unit E fits a cover to the connector (the upper connector is engaged).

Figure 33:
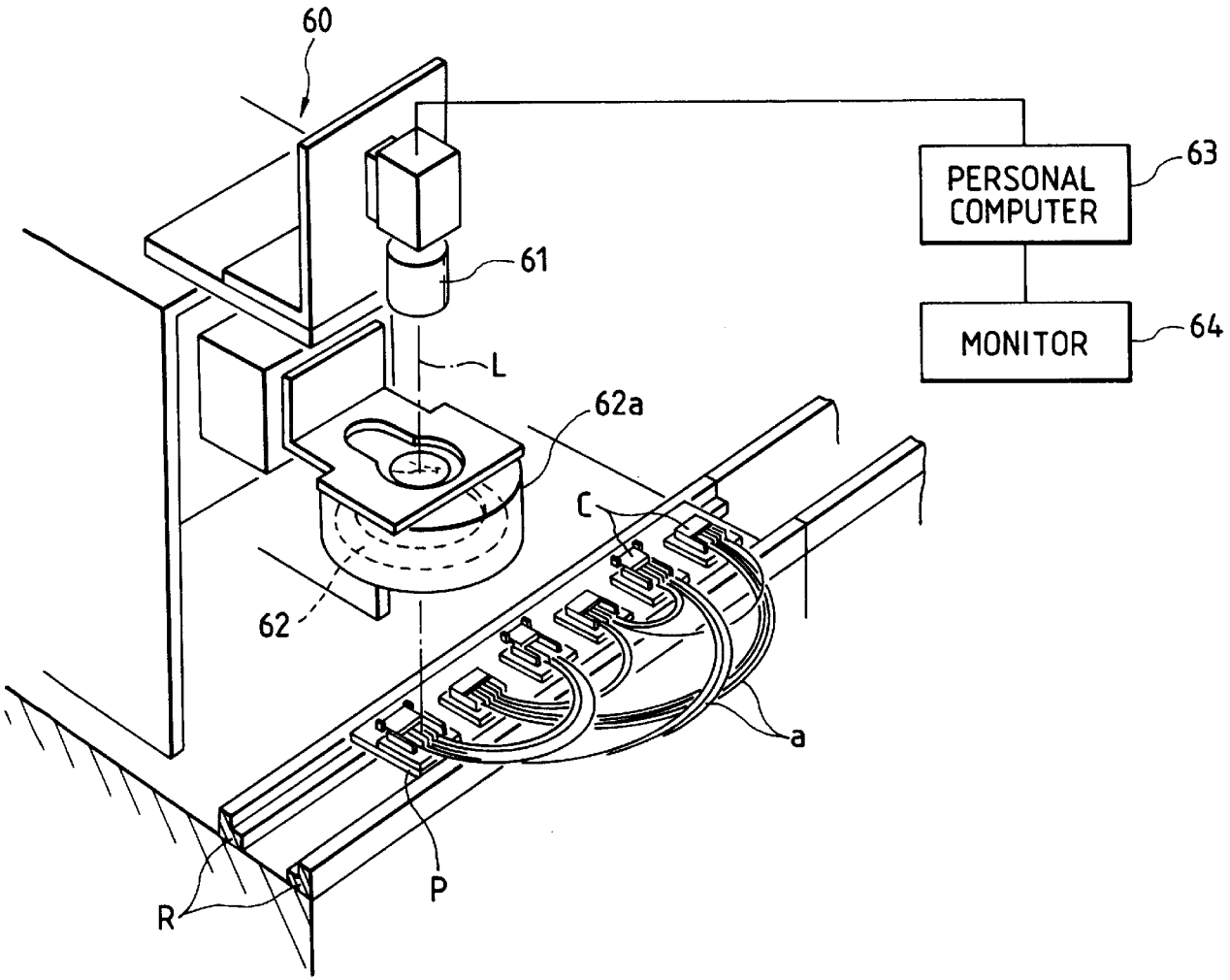
FIG. 33 is a perspective view showing an inspecting portion.

The appearance inspection is performed by the appearance inspecting unit 60 which performs an image process to inspect the position of the leading end of the electric wire a, presence of the electric wire a in the electric wire a and a degree of crimping of the barrel portion b at the crimping position. As shown in FIG. 33, the appearance inspecting unit 60 incorporates a CCD camera 61 serving as an image input unit; and a ring illumination 62 for obtaining uniform illumination. Thus, the terminal t made of metal material is illuminated and non-metal portions except for the terminal t, that is, the sheath of the electric wire a and the connector C are not illuminated.

Then, an image taken by the CCD camera 61 is subjected to a binary-coding process by the image processing unit to express the metal luster of with "white" pixels. The other non-luster portions are expressed with "black" pixels. A host computer for the image processing unit is a personal computer 63. A monitor 64 is provided to serve as a unit for outputting the binary image.

If a defect is detected in the appearance inspection of the state of the connection, detection of the defect is communicated. Moreover, the cover is not fit to the defective connector. Only satisfactory products are subjected to the process shown in FIG. 35 which is performed in a manner (not shown). Thus, the pair of housings C11 and C12, housings C21 and C22 and housings C31 and C32 are engaged to each other so that a wire harness W shown in FIG. 32 is obtained. The connector C to which the electric wire a has not satisfactorily been connected is recovered in a state where the connection (the defective connection) of the electric wire a is maintained. As described above, fitting of an unnecessary cover to the defective connector can be inhibited. Therefore, the availability can be improved and reduction in the material cost is permitted. The downward engaging position of each of the housings C11, C21 and C31 is determined by a stroke sensor 71.

The pallet P on which the wire harness W manufactured by fitting the covers C11 C21 and C31 to the housings C12, C22 and C32 is moved to the setting portion D so that the wire harness W is manually recovered. New housings C12, C22 and C32 are placed on the pallet P from which the wire harness W has been removed. Then, the pallet P is moved to the terminal mounting machine A. The foregoing operation is repeated so that the wire harnesses W shown in FIG. 36 are successively manufactured.

As described above, the present invention is structured such that the feeding pin is downwards inserted and allowed to pass through the insertion hole formed in the direction in which the hoop is fed. Moreover, the feeding pin is moved in the foregoing feeding direction. Therefore, the feeding pin can completely be caught by the hoop so that the hoop is restrained. As a result, overrunning of the hoop can completely be prevented. Hence it follows that cutting of the hoop and separation of the terminal by cutting can accurately be performed.

The holding pin for holding the hoop is downwards inserted into the insertion hole formed at a position different from the position at which the feeding pin is inserted prior to insertion and removal of the feeding pin. Thus, insertion and removal of the feeding pin can be performed in a state where the hoop is completely secured by the hoop holding pin. Therefore, further accurate feeding of the hoop, that is, accurate cutting and separation of the hoop can be prevented.

The means for inserting/removing the feeding pin with respect to the corresponding insertion hole and the means may be connected to each other by a linking mechanism such that alternate insertion and removal of the holding pin and the feeding pin with respect to the corresponding insertion hole are permitted. Thus, the two means can be operated by one operating source. As a result, reduction in the size of the apparatus and saving of power consumption are permitted.

The present invention may have a structure that the terminal insertion mechanism places the terminal separated from the hoop by the terminal inserting mechanism on the retaining surface, the height of which is the same as the surface of the bottom of the cavity, and causes the insertion pin arranged to move in the direction in which the terminal is inserted to push the rear surface of the terminal from just behind to insert the terminal. Thus, deformation and breakage of the terminal can be prevented, causing the terminal to accurately be inserted.

In each of the foregoing structures, the cutting mechanism is structured such that a locating pin is downwards inserted into the insertion hole adjacent to the position at which the cutting blade acts on the terminal prior to acting of the cutting blade on the terminal. Thus, cutting can be performed after the hoop has completely been stopped, causing the hoop to accurately be cut and the terminal to accurately be separated.

In each of the foregoing structures, each of the foregoing mechanism may be formed such that the operating mechanism of each of the mechanism for feeding the terminal hoop, the cutting mechanism and the terminal inserting mechanism is constituted by the cam and the link mechanism, and one operating shaft is commonly used as operating shaft of the mechanisms. Thus, the three mechanisms can be operated by one operating shaft. As a result, reduction in the size of the apparatus, decrease in the number of elements and saving of power consumption can be realized.

An apparatus for manufacturing a wire harness may comprise the terminal mounting machine for mounting the terminal on the connector; and the pressing machine, in series, disposed at the downstream position of the terminal mounting machine, wherein the terminal mounting machine is the above-mentioned machine for mounting the connector terminal. Thus, the size can be reduced as compared with that of the conventional apparatus. Thus, an apparatus for manufacturing a wire harness can be obtained which requires smaller power consumption and which is able to manufacturing the wire harness exhibiting a high quality at a satisfactory manufacturing yield.

What is claimed is:

1. A machine for mounting a terminal of a wire harness, comprising:

a feeding mechanism for feeding a terminal hoop;

a cutting mechanism for separating a terminal from said terminal hoop by cutting with a cutting blade thereof; and an inserting mechanism for inserting said separated terminal into a cavity of a connector housing, wherein said feeding mechanism for feeding said terminal hoop causes a feeding pin to be inserted into a hoop insertion hole so that said feeding pin is moved in the feeding direction and said cutting mechanism is structured such that a locating pin is movable with the cutting mechanism and inserted into the insertion hole adjacent to a position at which said cutting blade acts on said terminal prior to acting of said cutting blade on said terminal.

2. The machine for mounting a terminal of a wire harness according to claim 1, wherein said mechanism for feeding said terminal hoop is structured to insert a holding pin for holding said hoop into the insertion hole formed at a position different from a position at which said feeding pin is inserted prior to insertion and removal of said feeding pin.

3. The machine for mounting a terminal of a wire harness according to claim 2, wherein means for inserting/removing said feeding pin with respect to the corresponding insertion hole, and means for inserting/removing said holding pin with respect to the corresponding inserting hole are connected to each other by a linking mechanism such that alternate insertion and removal of said holding pin and said feeding pin with respect to the corresponding insertion hole are permitted.

4. The machine for mounting a terminal of a wire harness according to claim 1, wherein said terminal insertion mechanism places said terminal separated from said hoop by said terminal inserting mechanism on a retaining surface, the height of which is the same as the surface of the bottom of said cavity, and causes an insertion pin arranged to move in a direction in which said terminal is inserted to push the rear surface of said terminal from just behind to insert said terminal.

5. A machine for mounting a terminal of a wire harness, comprising:

a feeding mechanism for feeding a terminal hoop;

a cutting mechanism for separating a terminal from said terminal hoop by cutting with a cutting blade thereof; and an inserting mechanism for inserting said separated terminal into a cavity of a connector housing, wherein said inserting mechanism is structured such that said terminal separated from said hoop is placed on a retaining surface, the height of which is the same as the surface of the bottom of said cavity, and an insertion pin arranged to move in a direction in which said terminal is inserted pushes the rear surface of said terminal from just behind to insert said terminal and said cutting mechanism is structured such that a locating pin is movable with the cutting mechanism and inserted into the insertion hole adjacent to a position at which said cutting blade acts on said terminal prior to acting of said cutting blade on said terminal.

6. The machine for mounting a terminal of a wire harness according to claim 1, wherein an operating mechanism of each of said mechanism for feeding said terminal hoop, said cutting mechanism, and said terminal inserting mechanism is constituted by a cam and link mechanism, and one operating shaft is commonly used as operating shafts of said mechanisms.

7. An apparatus for manufacturing a wire harness, comprising:

a terminal mounting machine for mounting a terminal on a connector; and a pressing machine, in series, disposed at a downstream position of said terminal mounting machine, wherein said terminal mounting machine is a machine for mounting a connector terminal according to claim 1.

8. The machine for mounting a terminal of a wire harness according to claim 5, wherein an operating mechanism of each of said mechanism for feeding said terminal hoop, said cutting mechanism, and said terminal inserting mechanism is constituted by a cam and link mechanism, and one operating shaft is commonly used as operating shafts of said mechanisms.

9. An apparatus for manufacturing a wire harness, comprising:

a terminal mounting machine for mounting a terminal on a connector; and a pressing machine, in series, disposed at a downstream position of said terminal mounting machine, wherein said terminal mounting machine is a machine for mounting a connector terminal according to claim 5.

* * * * *